US006937827B2

(12) United States Patent
Katoh et al.

(10) Patent No.: US 6,937,827 B2
(45) Date of Patent: Aug. 30, 2005

(54) FIXING DEVICE AND IMAGE FORMING APPARATUS INCLUDING THE SAME

(75) Inventors: Yasuhisa Katoh, Kanagawa (JP); Kenji Ishii, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/624,551

(22) Filed: Jul. 23, 2003

(65) Prior Publication Data

US 2005/0074251 A1 Apr. 7, 2005

(30) Foreign Application Priority Data

Jul. 26, 2002 (JP) ..... 2002-218217

(51) Int. Cl.[7] ..... G03G 15/20
(52) U.S. Cl. ..... 399/68; 399/43; 399/69
(58) Field of Search ..... 219/216; 399/43, 399/45, 67, 68, 69, 70, 328

(56) References Cited

U.S. PATENT DOCUMENTS 4,843,214 A 6/1989 Higashi et al.
5,289,247 A * 2/1994 Takano et al. ..... 399/68
5,400,123 A 3/1995 Sato et al.
5,481,350 A 1/1996 Yasui et al.
5,541,712 A 7/1996 Fujitaka et al.
5,729,798 A 3/1998 Yasui et al.
5,745,247 A 4/1998 Yasui et al.
5,839,032 A 11/1998 Yasui et al.
6,112,047 A 8/2000 Kato et al.
6,134,418 A 10/2000 Kato et al.
6,263,185 B1 7/2001 Kato et al.

FOREIGN PATENT DOCUMENTS

JP 9-269692 10/1997
JP 11-65186 3/1999
JP 2001-27872 1/2001
JP 2001-83831 3/2001

* cited by examiner

*Primary Examiner*—Hoang Ngo
(74) *Attorney, Agent, or Firm*—Oblon, Spivak, McClelland, Maier & Neustadt, P.C.

(57) ABSTRACT

In accordance with the present invention, in an image forming apparatus including a fixing device for fixing a toner image on a sheet with heat at a nip between a fixing member accommodating a heat source and a pressing member not accommodating it, consecutive sheets are driven out of the fixing device at a variable interval without the number of sheets to be output within a preselected period of time being varied.

49 Claims, 14 Drawing Sheets

FIXING DEVICE AND IMAGE FORMING APPARATUS INCLUDING THE SAME

BACKGROUND OF THE INVENTION

1. Field of the Invention

The present invention relates to a fixing device for fixing a toner image on a sheet or recording medium with heat and a printer, facsimile apparatus or similar full-color or monochromatic image forming apparatus.

2. Description of the Background Art

Generally, an image forming apparatus includes a fixing device including a fixing member accommodating a heat source therein and a pressing member not accommodating it. The heating member and pressing member are configured to fix a toner image formed on a sheet or recording medium with heat and pressure. A current trend in the image forming apparatus art is toward a heat roller or fixing member having a wall thin enough to reduce the warm-up time of the image forming apparatus from the environment standpoint.

More specifically, to reduce the warm-up time, the temperature of the heat roller must be sharply raised to a preselected range of fixing temperature. It is therefore necessary to reduce the thermal capacity of the heat roller to a noticeable degree. However, the temperature of the heat roller, having such small thermal capacity, rapidly drops just after the start of sheet feed because the heat of the heat roller is absorbed by the press roller and sheets sequentially fed, failing to implement desired fixation quality.

In light of the above, it has been customary with an image forming apparatus of the type described to adopt any one of the following schemes. First, the press roller, which absorbs the heat of the heat roller, is implemented as a thin belt or a sponge roller in order to reduce the thermal capacity of the heat roller, thereby preventing the temperature of the heat roller from rapidly dropping. Second, power, or energy, to be applied to the heat source of the heat roller is increased by use of an exclusive power supply. Third, to promote efficient heating of the heat roller, use is made of induction heating available with eddy current to be generated in a conductive material by the electromagnetic induction of an alternating electromagnetic field or a resistance loss of skin current.

However, the conventional schemes described above are not feasible for a high-speed machine needing additional power other than power for fixation. More specifically, such schemes are applicable only to an about fifty-paper machine in which power of PPM (Papers Per Minute) (A4)×20 W is available for heating the heat roller.

Technologies relating to the present invention are disclosed in, e.g., Japanese Patent Laid-Open Publication Nos. 9-269692, 11-65186, 2001-27872 and 2001-83831.

SUMMARY OF THE INVENTION

It is an object of the present invention to provide a fixing device capable of reducing warm-up time with a fixing member having a thin wall, and an image forming apparatus including the same.

It is another object of the present invention to provide a fixing device capable of protecting fixation quality from degradation ascribable to the temperature drop of a fixing member just after the start of sheet feed, and an image forming apparatus including the same.

In accordance with the present invention, in an image forming apparatus including a fixing device for fixing a toner image on a sheet with heat at a nip between a fixing member accommodating a heat source and a pressing member not accommodating it, consecutive sheets are driven out of the fixing device at a variable interval without the number of sheets to be output within a preselected period of time being varied.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

The present invention will be described with reference to the accompanying drawings hereinafter.

[1] Image Forming Apparatus

Figure 1:
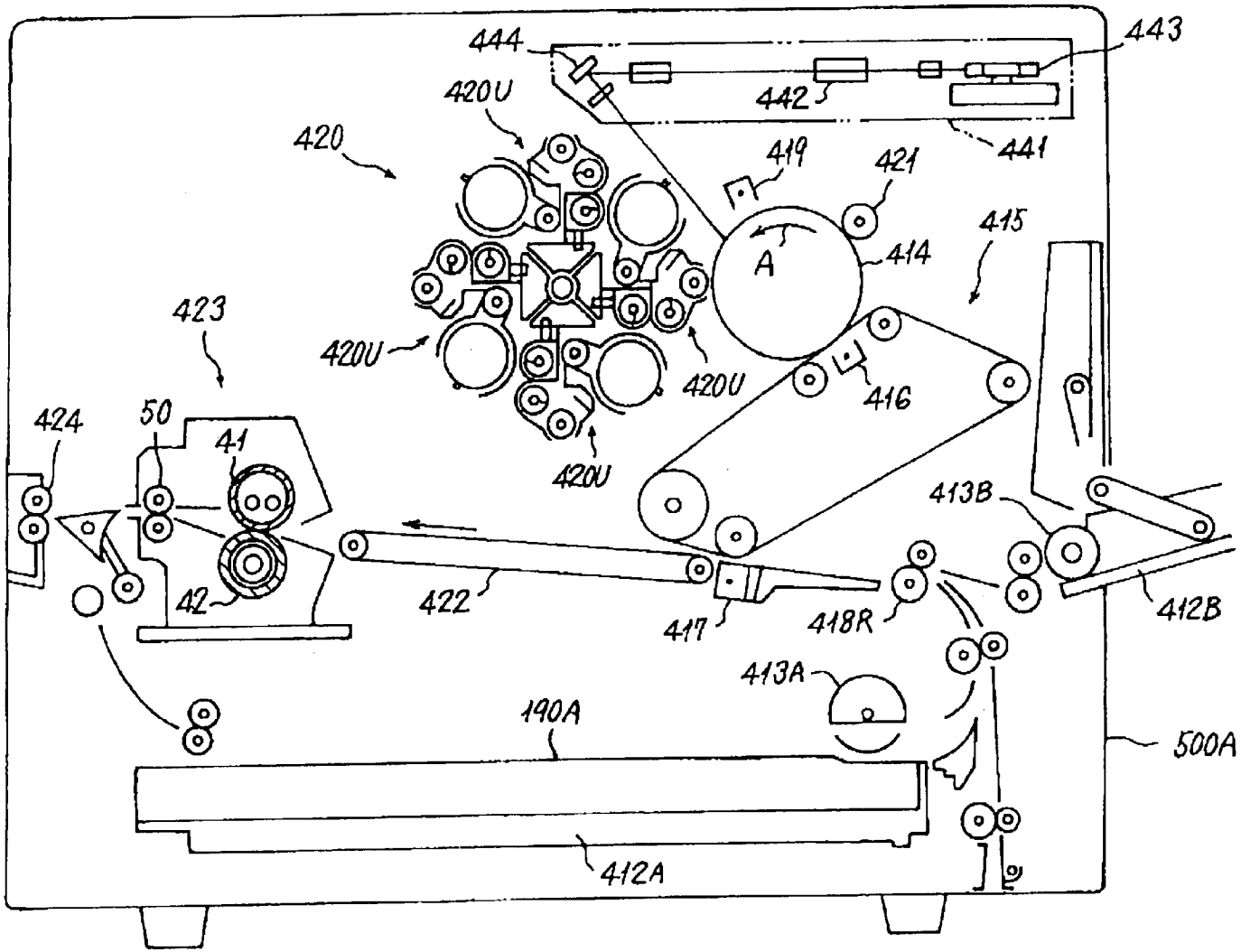
FIG. 1 is a view showing an image forming apparatus to which the present invention is applied.

Referring to FIG. 1 of the drawings, an image forming apparatus to which the present invention is applied is shown. While the image forming apparatus is implemented as a full-color image forming apparatus, it may, of course, be implemented as a black-and-white image forming apparatus so long as it includes a fixing device of the type using heat. As shown, the image forming apparatus includes a frame or body 500A. Laser writing means 441 is positioned in the upper portion of the frame 500A and includes a laser as a light source. A laser beam issuing from the laser is incident to a photoconductive drum 414 or image carrier via a polygonal mirror 443, an fθ lens 442, and a mirror 444.

The drum 414 is rotatable in a direction indicated by an arrow A in FIG. 1. Sequentially arranged around the drum in the direction A are a revolver type developing device 420, an intermediate image transfer belt 415, a drum cleaner 421, and charging means 419 implemented as, e.g., a scorotron charger. Primary image transferring means 416 faces the drum 414 with the intermediary of the intermediate image transfer belt (simply belt hereinafter) 415 and is implemented as a scorotron charger. Secondary image transferring means 417 is positioned below the belt 415 with the intermediary of a sheet path.

A sheet cassette 412A is positioned in the lower portion of the frame 500A and joins in duplex print mode operation as well. A pickup roller 413A pays out the top sheet 190A from the sheet cassette 412A while separating means, not shown, separates the top sheet 190A from the underlying sheets. The sheet 190A is conveyed to a registration roller pair 418R and stopped for a moment thereby. A manual sheet feed tray 412B and pickup means 413B, serving as manual sheet feeding means in combination, are available for manual sheet feed.

While the drum 414 in rotation is charged by the charging means 419, the laser writing means 441 scans the charged surface of the drum 414 with the laser beam to thereby form a latent image on the drum 414. The revolver type developing device (simply revolver hereinafter) 420 develops the latent image with one of four developing units 420U with a developer, i.e., toner T for thereby producing a corresponding toner image. The four developing units 420 are respectively assigned to cyan, magenta, yellow and black.

The first image transferring means 416 transfers the toner image from the drum 414 to the belt 415. Subsequently, the drum cleaner 421 removes the developer left on the drum 414 to thereby prepare the drum 414 for the next image formation.

The procedure described above is repeated to sequentially transfer consecutive toner images of different colors to the belt 415 one above the other, thereby completing a full-color image on the belt 415. The secondary image transferring means 417 transfers the full-color image from the belt 415 to the upper surface of the sheet 190A fed from the registration roller pair 418R at preselected timing. Cleaning means, not shown, removes toner left on the belt 415 after the secondary image transfer. The sheet 190A, carrying the toner image on its upper surface, is conveyed via a fixing device 423 and then driven out of the frame 500A to a tray, not shown, by an outlet roller pair 424. The fixing device 423 fixes the toner image on the sheet 190A with heat and pressure.

While some image forming apparatus is configured to transfer a toner image to the lower surface of a sheet and then fix it on the sheet, preferred embodiments of the present invention to be described hereinafter are practicable even with such an image forming apparatus.

[2] Fixing Device

Figure 2:
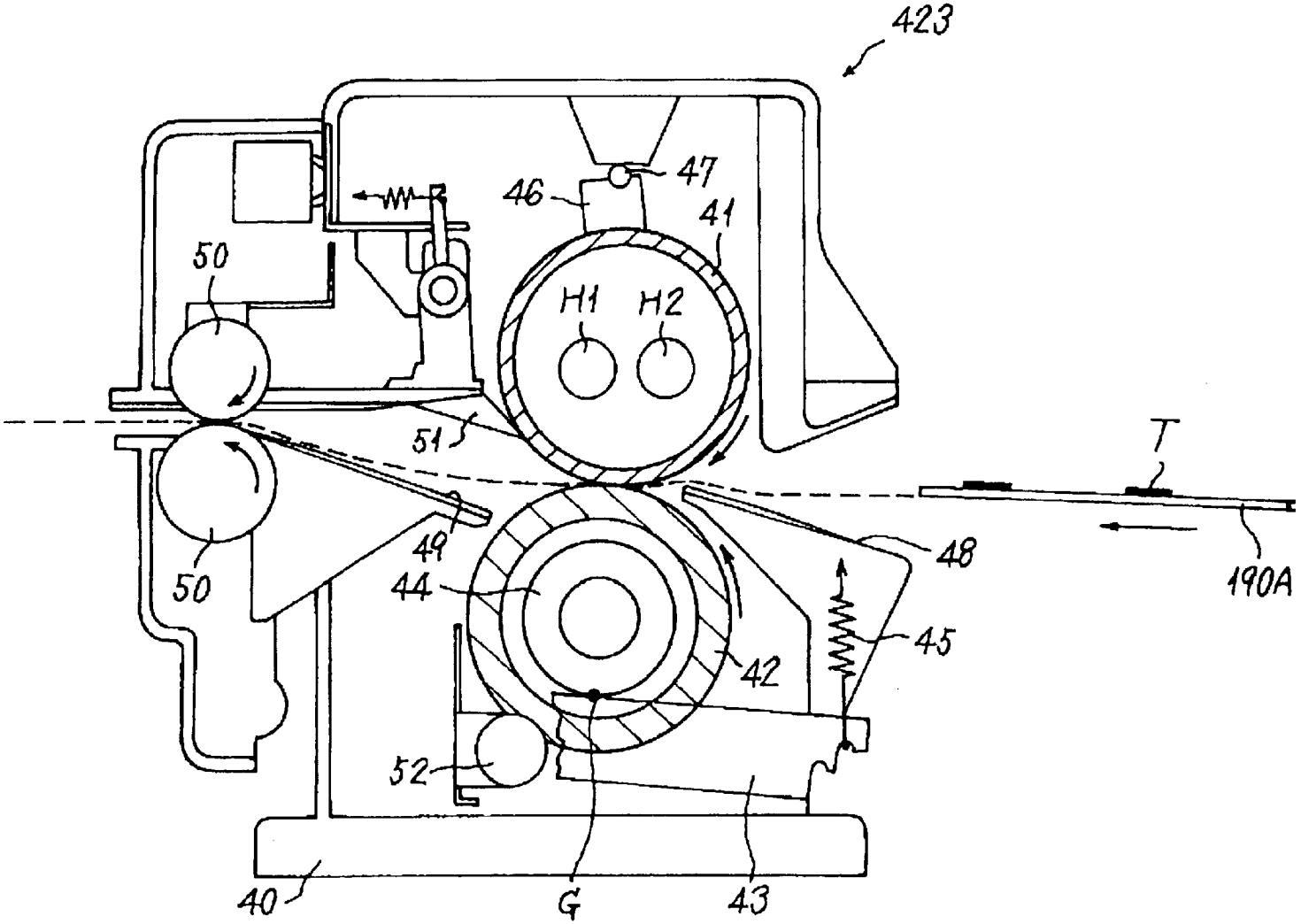
FIG. 2 shows a first embodiment of the fixing device in accordance with the present invention.

Reference will be made to FIG. 2 for describing a first embodiment of the fixing device 423 in accordance with the present invention. As shown, the fixing device 423 includes a casing 40 and a heat roller or fixing member 41 and a press roller or pressing member 42 disposed in the casing 40. The heat roller 41 is journalled to opposite side walls, not shown, of the casing 40 in the upper portion of the casing 40. Likewise, the press roller 42 is journalled to the side walls of the casing 40 in the lower portion of the casing 40 via bearings 44 (only one is visible). Each bearing 44 is constantly biased upward by a lever 43, which is biased by a tension spring 45 about is one end, via a contact point G. Consequently, as shown in FIG. 3, the press roller 42 is pressed against the heat roller 41 over a nip having a width NP and is rotated by the heat roller 41 or driven to follow the rotation of the heat roller 41.

At least the surface of the press roller 42 is formed of an elastic material. Therefore, by varying the bias of the spring 45, it is possible to vary the nip width NP. It follows that in the illustrative embodiment and other embodiments to follow, the nip width NP can be confined in the interval between the trailing edge of the preceding sheet and the leading edge of the following sheet in relation to sheet conveying speed. For example, the nip width NP increases if the spring 45 is replaced with one exerting a heavier bias or if the position where the spring 45 is anchored is shifted above a reference position; the former decreases if the latter is shifted below the reference position.

A thermistor or temperature sensing means 46 adjoins the upper portion of the heat roller 41 for sensing the surface temperature of the heat roller 41, so that fixing temperature at the nip can be determined on the basis of the output of the thermistor 46. A temperature fuse 47 is connected to the thermistor 46. When the surface temperature of the heat roller 41 rises above a preselected upper limit, as determined by the thermistor 46, the temperature fuse 47 interrupts power feed to heat sources H1 and H2 disposed in the heat roller 41. It is to be noted that the heat sources H1 and H2 are selectively turned on or turned off independently of each other by control means 60, see FIGS. 5 and 6.

Figure 3:
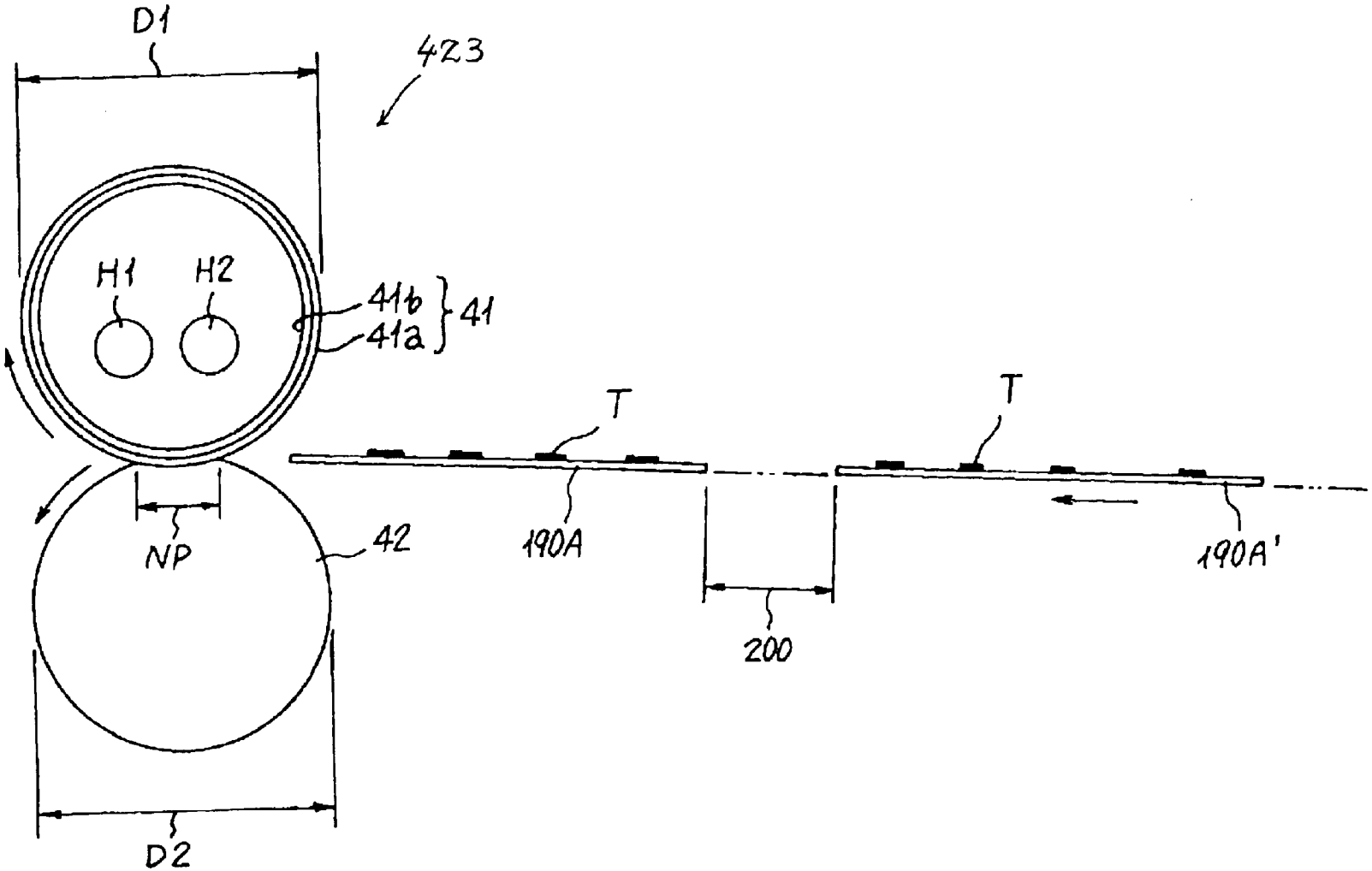
FIG. 3 shows a heat roller and a press roller included in the first embodiment specifically.

As shown in FIGS. 2 and 3, the sheet 190A, carrying the toner T thereon, is introduced into the fixing device 423 via an inlet guide 48 located at the right-hand side. The heat roller 41 and press roller fixes the toner T on the sheet 190A being conveyed via the nip width NP with heat and pressure. Subsequently, the sheet 190A is driven out of the fixing device 423 by a roller pair 50 while being guided by an outlet guide 49.

A peeler 51 is held in light contact with the portion of the heat roller 41 downstream of the nip, as seen in the direction of rotation of the heat roller 41 indicated by an arrow, and peels off the leading edge of the sheet 190A from the heat roller 41. A cleaning roller 52 is held in contact with the portion of the press roller 42 downstream of the nip, as seen in the direction of rotation of the press roller 42 indicated by an arrow, and rotatable to clean the surface of the press roller 42.

As shown in FIG. 3, the heat roller 41 has an outside diameter D1 of 50 mm and is made up of a hollow cylindrical core 41*b* formed of aluminum and having wall thickness as small as 0.5 mm and a surface layer 41*a* implemented as a 300 $\mu$m thick, silicone rubber layer. The press roller 42 has an outside diameter D2 of 50 mm and formed of foam silicone having low hardness. The heat roller 41 with such small wall thickness and therefore small thermal capacity successfully reduces warm-up time, e.g., reduces it to 25 seconds or less when installed in a 70 CPM (Copy Per Minute) machine.

More specifically, two heat sources H1 and H2 are disposed in the hollow cylindrical heat roller 41. The silicone rubber layer, covering the surface of the aluminum core, reduces the thermal capacity of the heat roller 41. The thermal capacity of the heat roller 41 is further reduced when the roller 41 is combined with the solid press roller 42 formed of foam silicone or similar elastic material. This, coupled with the two heat rollers H1 and H2, allows the heat roller 41 to be warmed up in a short period of time.

Figure 4:
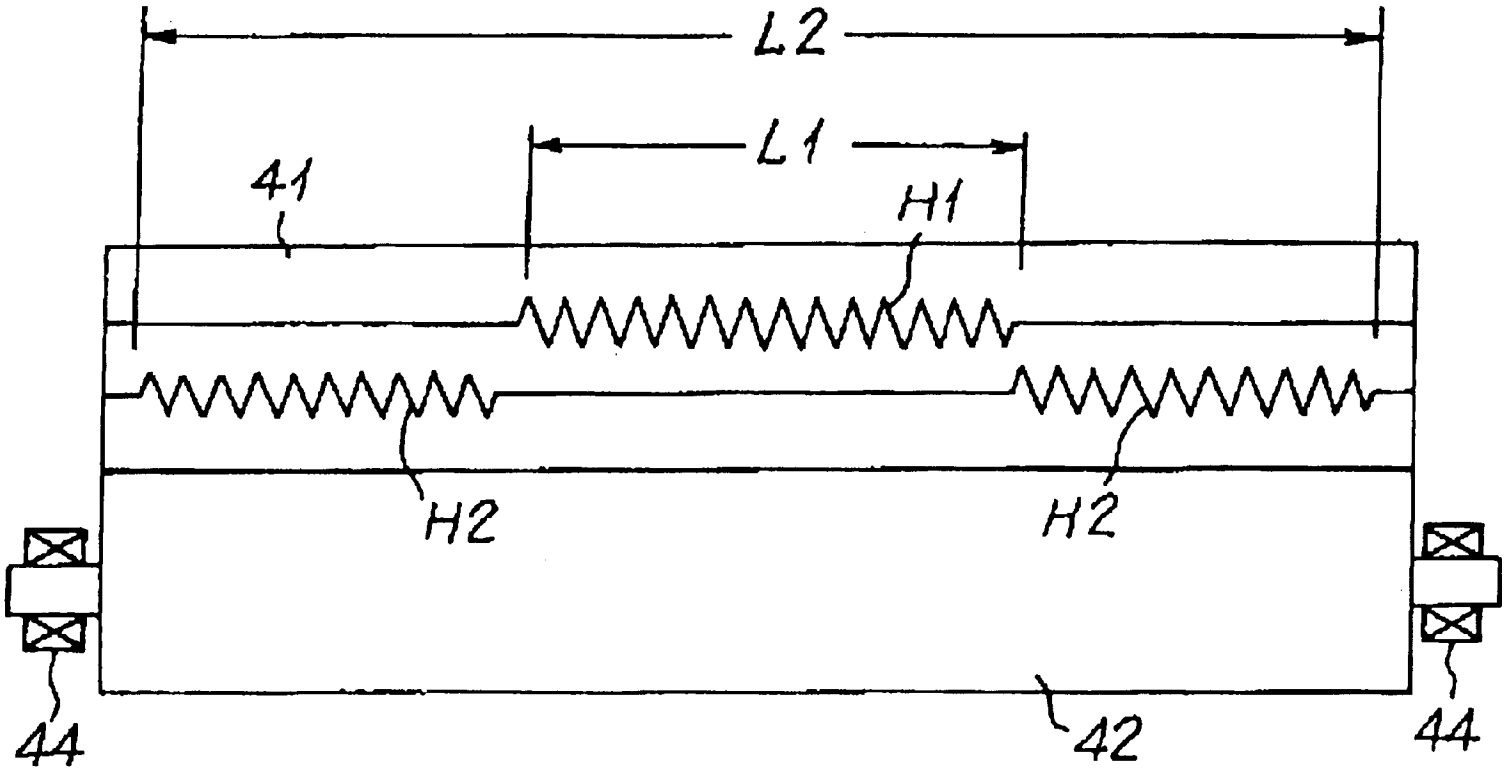
FIG. 4 shows the configuration of a heat source also included in the first embodiment.

As shown in FIG. 4, the heat sources H1 and H2 extend in the axial direction of the heat roller 41 each. The heat source H1 has a 600 W, light emitting heater portion at the center in the axial direction. The heat source H2 has two 650 W, light emitting heater portions at opposite end portions in the axial direction. The light emitting portion of the heat source H1 has a length L of 210 mm corresponding to the width of a sheet of size A4 fed in a profile position. The total length L2, including the lengths of the light emitting portions of the heat source H2, is 330 mm large enough to cover sheet sizes of up to A3.

As stated above, the heat sources H1 and H2 are implemented as an electric heater whose center portion and end portions can be selectively, efficiency energized in accordance with the sheet size, promoting energy saving.

Figure 5:
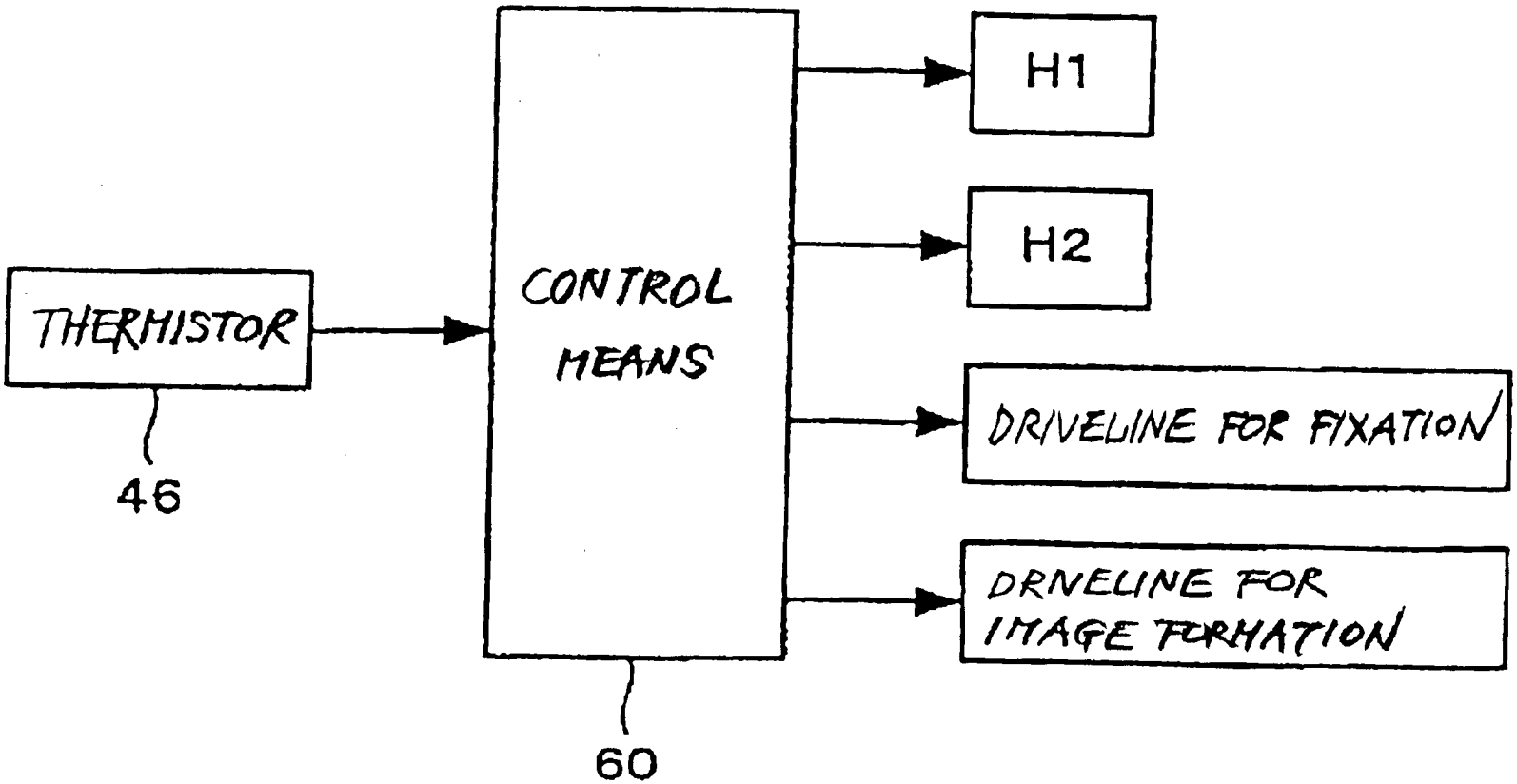
FIGS. 5 and 6 are schematic block diagrams each showing a particular control system included in the image forming apparatus.
Figure 6:
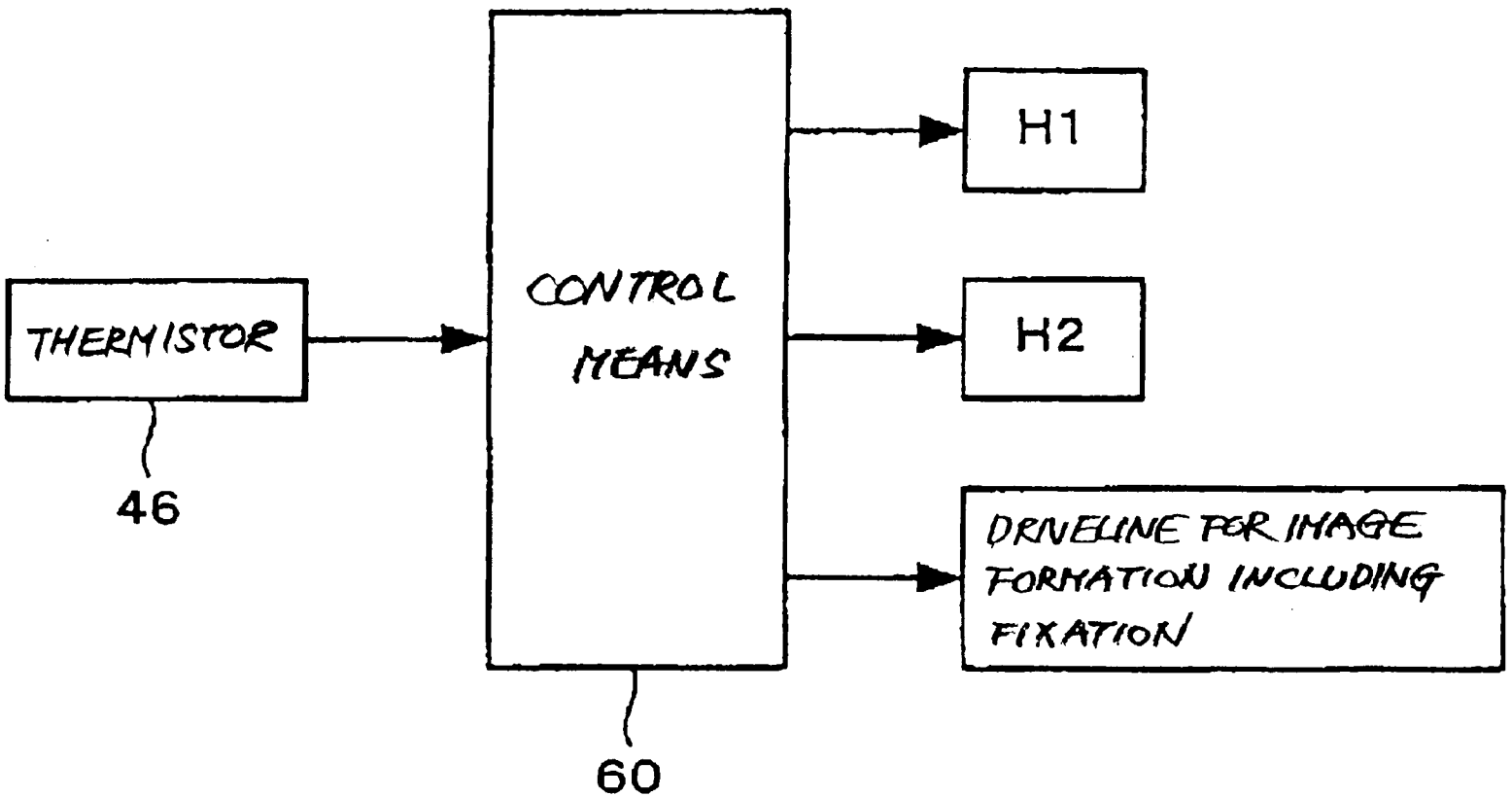

As shown in FIGS. 5 and 6, the control means 60, including a CPU (Central Processing Unit) not shown, selectively turns on or turns off the heat sources H1 and H2 individually in accordance with the output of the thermistor 46, controlling fixing temperature in accordance with the sheet size. If the heat roller is provided with a heat source, then the temperature sensing means will sense the surface temperature of the heater roller.

In the case of an image forming apparatus configured to fix a toner image formed on the lower surface of a sheet, the heat roller and press roller are replaced with each other in the up-and-down direction. The present invention is similarly applicable to such an image forming apparatus.

[3] Experiments 3-1. Experimental Conditions

Sheets were passed through the image forming apparatus [1] loaded with the fixing device [2], but not using the present invention, under the following conditions:

sheet linear velocity: 360 mm/sec
nip width NP: 9 mm
total power fed to heat sources H1 and H2: 900 W
PPM: 70/A4 landscape or 60/A4 landscape
heat roller temperature
(target fixing temperature): 185° C.
sheets: NBS 90K (available from RICOH)/A4 landscape
conveyance: 100 consecutive sheets just after
warm up to 185° C.
image ratio: about 30%, uniformly distributed As for heat roller temperature, the heat sources H1 and H2 are selectively turned on or turned off to maintain the surface temperature of the heat roller 41 at 185° C. This is also true with the other experiments to follow.

Even when power feed to the heat sources H1 and H2 is so controlled, the heat roller temperature, in practice, rises above or drops below 185° C. because the press roller 42, toner and consecutive sheets absorbs heat.

Figure 7:
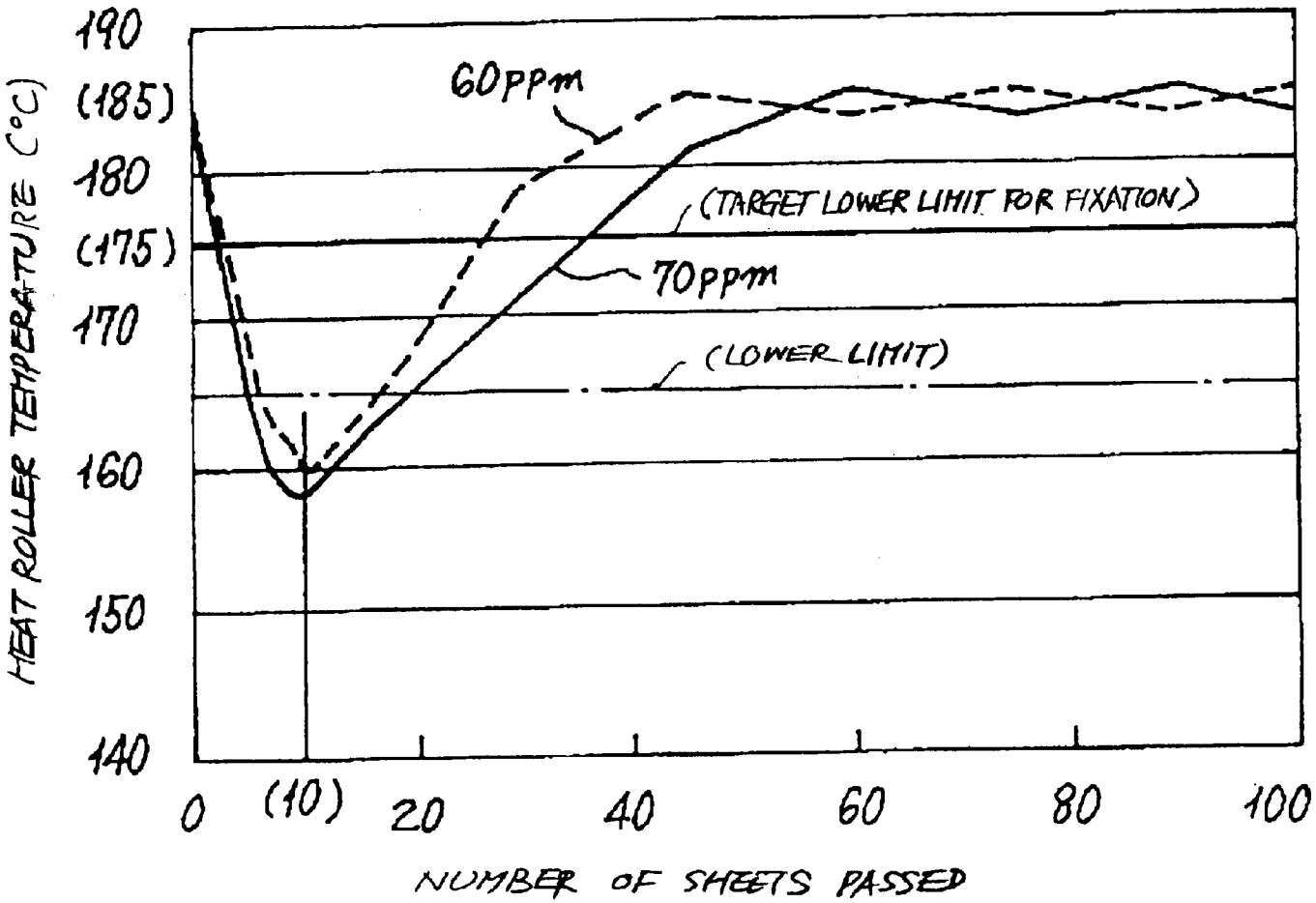
FIG. 7 is a graph showing how the temperature of a heat roller drops in the initial stage of sheet feed in a conventional fixing device.

FIG. 7 shows how the heat roller temperature varies when sheets are sequentially fed in the above conditions. As shown, the heat roller temperature sharply drops from 185° C. to 160° C. when just ten sheets are passed at the rate PPM of 70 or 60. After such a drop, the heat roller temperature again starts rising little by little and finally reaches 185° C.; the recovery is more sharp when PPM is 60 than when it is 70.

Because the lower limit of fixing temperature particular to NBS 90K sheets used is 165° C., the heat roller temperature drops below the lower limit of 165° C. when about ten sheets are passed, failing to fix toner images. Considering irregularity in environment and control, a practical target lower limit of fixing temperature is 175° C. In this respect, the heat roller temperature drops below the lower limit in terms of the number of sheets passed after the start of sheet feed.

3.2 Drop of Fixing Temperature just After Sheet Feed

Sheets and toner are expected to absorb more heat from the heat roller 41 when the rate PPM is 70 than when it is 60. However, as FIG. 7 indicates, up to the tenth sheet after the start of sheet feed, the fixing temperature drops in substantially the same manner for both of 60 PPM and 70 PPM. This suggests that in the case of 60 PPM smaller than 70 MMP, the heat of the heat roller 41 is absorbed by something other than the sheets and toner. As shown in FIG. 3, nothing exists between the trailing edge of the preceding sheet 190A and the leading edge of the following sheet 190A, i.e., sheet interval 200. Therefore, when the nip width NP coincides with the sheet interval 200, heat is transferred from the heat roller 41 to the press roller 42 directly contacting the heat roller 41. This presumably is the cause of the rapid temperature drop of the heat roller 41.

In this connection, a sheet interval time, corresponding to the sheet interval 200, was measured to be 417 ms when the rate was 60 PPM or 274 ms when it was 70 PPM. This indicates that the press roller 42 absorbs about 1.5 times more heat from the heat roller 41 when the rate is 60 PPM than when it is 70 PPM, proving the cause of the sharp temperature drop stated above. This is why the fixing temperature drops when the rate is 60 PPM in the same manner as when it is 70 PPM.

3-3. Recovery after Temperature Drop

As FIG. 7 indicates, after the drop stated above, the temperature of the heat roller 41 is restored to about 185° C. more sharply when the rate is 60 PPM than when it is 70 PPM, as stated earlier. This is accounted for by the following occurrences (1) and (2):

(1) The press roller 42 absorbs the heat of the heat roller 41 and is therefore warmed to a certain degree up to the time when about ten sheets are passed, so that the rate at which the heat of the roller 41 is absorbed by the roller 42 decreases after the passage of about ten sheets; and (2) The number of times the sheets and toner absorbs the heat of the heat roller 41 is smaller when the rate is 60 PPM than when it is 70 PPM.

It follows that temperature recovery is, of course, more rapid when PPM is 60 than when it is 70.

3-4. Relation between Sheet Interval Time and Heat Roller Temperature

Figure 8:
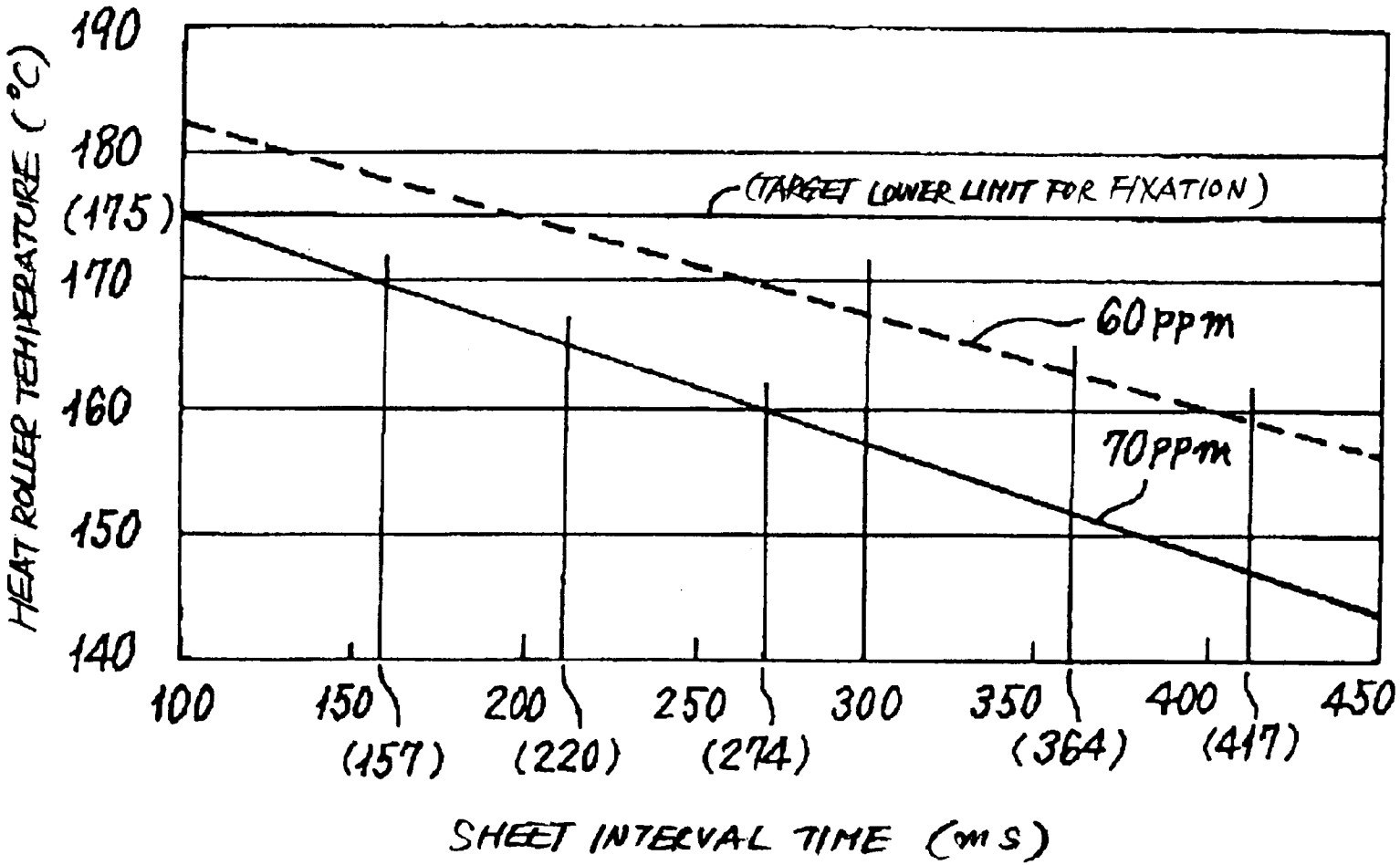
FIG. 8 is a graph showing the temperature of the heat roller varying in accordance with the sheet interval time.

A change in sheet interval time has influence on the fixing temperature, as determined by the above 3-2. Experiments were conducted to determine how the temperature drop of the heat roller 41 varied when the sheet interval time was simply varied under the following conditions:

sheet linear velocity: 360, 330 and 300 mm/sec
sheet interval time: 274, 220 and 157 ms for 70 PPM
417, 364 and 300 ms for 60 PPM
fixing time: 25 ms (established for each linear velocity by adjusting nip width NP with pressing means, e.g., spring 25
total heat source (H1 and H2) power: 900 W
PPM: 70/A4 and 60 A4/landscape
heat roller temperature
(target fixing temperature): 185° C.
sheets: NBS 90K/A4 landscape
conveyance: 100 consecutive sheets just after warm up to fixing temperature
image ratio: about 30%, evenly distributed Power of 900 W is selected because such power is customary with image forming apparatuses belonging to this class. FIG. 8 shows the variation of heat roller temperature determined under the above conditions. As shown, for both of 60 PPM and 70 PPM, the lower limit of fixing temperature drop rises as the sheet interval time decreases, proving that the shorter the sheet interval time, the shorter the period of time over which the press roller 42 absorbs the heat of the heat roller 41.

More specifically, as a result of decrease in sheet interval time, the temperature drops at a rate of about 7.5 deg/100 ms for 60 PPM or at a rate of about 9 deg/100 ms for 70 PPM for the following reason. A decrease in sheet interval by 100 ms translates into a period of time of 6 sec for 60 PPM (100 ms×60) or a period of time of 7 sec for 70 PPM (100 ms×70). Therefore, the total sheet interval time, i.e., the period of time over which the press roller 42 absorbs the heat of the heat roller 41 is shorter when PPM is 60 than when it is 70, reducing the degree of drop from the initial temperature.

3-5. Examples

Experimental results stated in the above 3-1. through 3-4. indicate the following:

(1) Reducing the sheet interval time is effective to obviate the drop of fixing temperature; and (2) When the temperature of the press roller 42 is low, the temperature of the heat roller 41 is controlled by the heat absorption by the press roller 42 while, when the former rises to a certain degree, the latter is controlled by the heat absorption by the sheets and toner.

It follows that by adequately combining the above two factors (1) and (2), it is possible to achieve power saving with the heat roller 41 whose wall thickness is reduced to promote the rapid warm-up of the fixing device and therefore the warm-up of the entire apparatus. More specifically, the sheet interval or sheet interval time should be reduced just after the start of sheet feed, then increased, and then controlled to a preselected interval that balances the heat generation and heat radiation of the heat roller 41.

Figure 9:
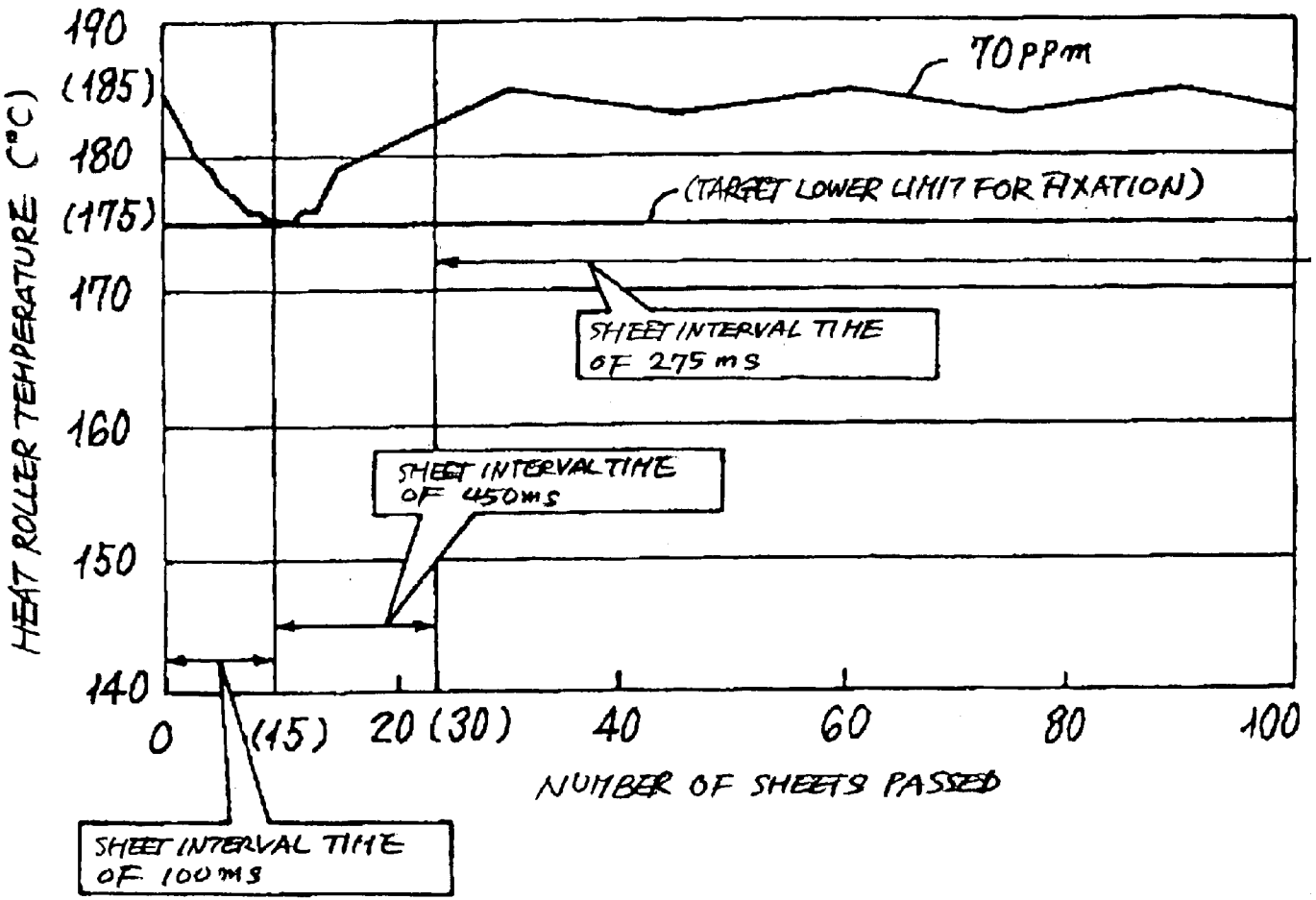
FIG. 9 is a graph showing the temperature characteristic of the heat roller of the illustrative embodiment occurring when the sheet interval time is varied.

FIG. 9 shows the results of experiments conducted under the following condition for confirming the effect described above:

PPM: 70 sheet linear velocity: 360 mm/sec sheet interval time: 100 ms up to 1 to 15 sheets 450 ms up to 16 to 30 sheets 275 ms after 31 sheets inclusive (70 sheets in total for a minute)

nip width NP: 9 mm heat roller temperature (target fixing temperature): 185° C.

sheets: NBS 90K/A4 landscape conveyance: 100 consecutive sheets just after warm up to 185° C.

image ratio: about 30%, evenly distributed

As FIG. 9 indicates, because the sheet interval time is as short as 100 ms just after the start of sheet feed, the press roller 42 absorbs a minimum of heat from the press roller 41. As a result, the drop of heat roller temperature was improved by about 17 degrees, compared to the experimental result shown in FIG. 7, and controlled to the target lower limit of 175° C. Subsequently, when about fifteen sheets are passed, i.e., when the press roller 42 is warmed, the sheet interval time is extended to 450 ms. At this time, therefore, the amount of heat to be absorbed by the sheets and toner is reduced, allowing the heat roller temperature to be rapidly restored to the target fixing temperature of 185° C.

After the heat roller temperature has been restored to 185° C., the sheet interval time is reduced to 275 ms, which is the mean value of 100 ms and 450 ms. This sheet interval time 450 ms corresponds to one to hold when the number of sheets that can be dealt with for a preselected time (xx PPM), as listed in a catalogue or the like as a specification, should be achieved without varying the interval between sheets being conveyed as in the present invention.

The heat balance of the heat roller 41 was substantially stably maintained at 185° C. when the sheet interval time was 275 ms. Consequently, power of 900 W sufficed to prevent the temperature from dropping below 175° C. and 70 PPM.

As stated above, the sheet interval, i.e., the interval between the output of the preceding sheet from the fixing device and the output of the following sheet is selected to be 100 ms up to the fifteenth sheet after the start of discharge or 450 ms from the sixteenth to thirtieth sheets or 275 ms from the thirty-first and successive sheets. It is therefore possible to protect fixation quality from degradation ascribable to the temperature drop of the fixing member (heat roller 41) to occur just after the start of sheet feed. This can be done without increasing a period of time in which the conventional technology, which does not vary the sheet interval time, passes the total number of sheets or increasing power necessary for a heat source. Stated another way, the above advantage is achievable while saving power with the fixing member whose wall thickness is reduced to promote rapid warm-up.

The interval between sheets being conveyed refers to the interval between the trailing edge of the preceding sheet and the leading edge of the following sheet when the consecutive sheets are sequentially conveyed via at least the fixing device 423, more specifically the nip of the fixing device 423. By varying the sheet interval while maintaining the conveying speed constant, it is possible to insure fixation at temperature above the target lower limit of 175°. However, to simplify control, varying only the interval between sheets being sequentially conveyed via the nip may be replaced with varying the interval, in the image forming process of the entire image forming apparatus, between any desired point of an image forming cycle assigned to the preceding sheet and above point of an image forming cycle assigned to the following sheet. This is also successful to vary the distance between the trailing edge of the preceding sheet and the leading edge of the following sheet when the sheets are sequentially conveyed via the nip width NP.

For example, there may be varied the interval between the preceding and following images to be sequentially formed by the image forming process under the control of a program stored in the image forming apparatus beforehand.

Assume that the interval between the formation of the preceding image and that of the following image is varied in the image forming process without the conveying speed on the sheet path being varied, as stated above. Then, paying attention to sheets sequentially driven out by the outlet roller pair 424, the interval of conveyance in terms of a period of time from the output of the preceding sheet to that of the following sheet is varied every time a preselected number of sheets are passed. Of course, the variation of the interval of conveyance in terms of the above period of time appears anywhere on the sheet path and is therefore the same when observed at the inlet of the fixing device or at the roller pair 50.

The variation of the interval of conveyance is synonymous with the variation of spatial distance from the trailing edge of the preceding sheet to the leading edge of the following sheet. That is, the above variation is synonymous with the sequential variation of the sheet interval 200, FIG. 3, to a distance of 36 mm necessary for fifteen sheets to be sequentially conveyed at a linear velocity of 360 mm/sec by taking 100 ms, then to a distance of 162 mm necessary for the sixteenth to thirtieth sheets to be sequentially conveyed at the above linear velocity by taking 45 ms, and then to a distance of 99 mm necessary for the thirty-first to successive sheets to be sequentially conveyed at the same linear velocity by taking 275 ms.

More specifically, at any point on the sheet path extending from the sheet cassette 412A to the tray, not shown, via the secondary image transferring means 417, belt 422, fixing device 423 and outlet roller pair 424, the interval of conveyance is selected to be a sheet interval time α' of 100 ms shorter than a usual interval γ' up to the fifteenth sheet, to be a sheet interval time β' of 450 ms longer than the usual interval γ' from the sixteenth to thirtieth sheets or to be 275 ms, which is the mean value of α' and β' or usual interval, from the thirty-first sheet and successive sheets. The usual interval may be an interval to hold when the present invention is not used. The advantage stated earlier can therefore be achieved only if such relatively simple conditions are established.

Assume that the sheet interval 200, FIG. 3, just after the start of sheet feed is γ of 99 mm (A4 landscape, linear velocity of 360 mm/sec) corresponding to the number of sheets to be output in a preselected period of time. Then, an interval α of 36 mm necessary for a sheet to be conveyed at a linear velocity of 360 mm/sec in 100 ms and shorter than the usual interval γ is selected up to the fifteenth sheet after the start of sheet feed. Subsequently, an interval β of 162 mm necessary for a sheet to be conveyed at the above linear velocity in 450 ms and longer than the usual interval γ is selected from the sixteenth to thirtieth sheets. Finally, the usual speed of 16.5 mm, which is the mean value of α and β or usual interval, is selected from the thirty-first sheet and successive sheets. This is also successful to relatively easily achieve the previously stated advantage without changing the number of sheets to be output for a preselected period of time, as listed in a catalog or the like.

Assuming that the sheet interval is not reduced to 36 mm stated above, then a period of time just after the start of sheet feed refers to a time zone in which the fixing temperature drops below the lower limit of 165° C. up to the tenth sheet due to the absorption of heat of the press roller 42 by the press roller 42, as stated with reference to FIG. 7. In the illustrative embodiment the above time zone extends to the fifteenth sheet, as shown in FIG. 9. By so setting the time zone just after the start of sheet feed, it is possible to reduce the chance that the press roller 42 absorbs the heat of the heat roller 41 just after the start of sheet feed, thereby obviating defective fixation.

As for a specific control method, when the fixing device 423 is driven by an exclusive driveline independent of a driveline assigned to the image forming apparatus, the control system shown in FIG. 5 is used to start and stop, in accordance with the number of sheets counted, the operation of the former driveline in interlocked relation to the latter driveline. On the other hand, when the fixing device 423 shares the same driveline as the image forming apparatus, the control system shown in FIG. 6 is used to start and stop the operation of the fixing device 423 together with the image forming apparatus in accordance with the number of sheets counted. In any case, the operation of the fixing device 423 can be easily controlled.

3-6. Other Examples

Experimental results stated in the above 3-1. through 3-4. indicate that reducing the sheet interval time is effective to obviate the drop of fixing temperature, and that when the temperature of the press roller 42 is low, the temperature of the heat roller 41 is controlled by the heat absorption by the press roller 42 while, when the former rises to a certain degree, the latter is controlled by the heat absorption by the sheets and toner, as stated earlier. However, paying attention to the fact that heat transfer from the heat roller 41 to the press roller 42 should be obviated, it is, of course, most effective to interrupt the rotation of the heat roller 41. This limits the heat transfer from the heat roller 41 only to the same point of the press roller 42 contacting the heat roller 41, thereby realizing rapid restoration of the heat roller temperature.

Further, because the heat roller 41 having a thin wall, as stated earlier, is provided with an extremely sharp temperature elevation slope for a unit time, the heat roller temperature can be sufficiently restored even if its rotation is interrupted only for a short period of time. In this connection, the temperature elevation slope experimentally determined was about 6.5 deg/sec.

For the reasons stated above, it is possible to save energy with the heat roller 41 whose wall thickness is reduced by interrupting the rotation of the heat roller 41 when the nip width NP coincides with the interval between the trailing edge of the preceding sheet and the leading edge of the following sheet. This can be done without varying the number of sheets to be output from the fixing device for a preselected period of time. The results of two specific experiments will be described hereinafter.

Figure 10:
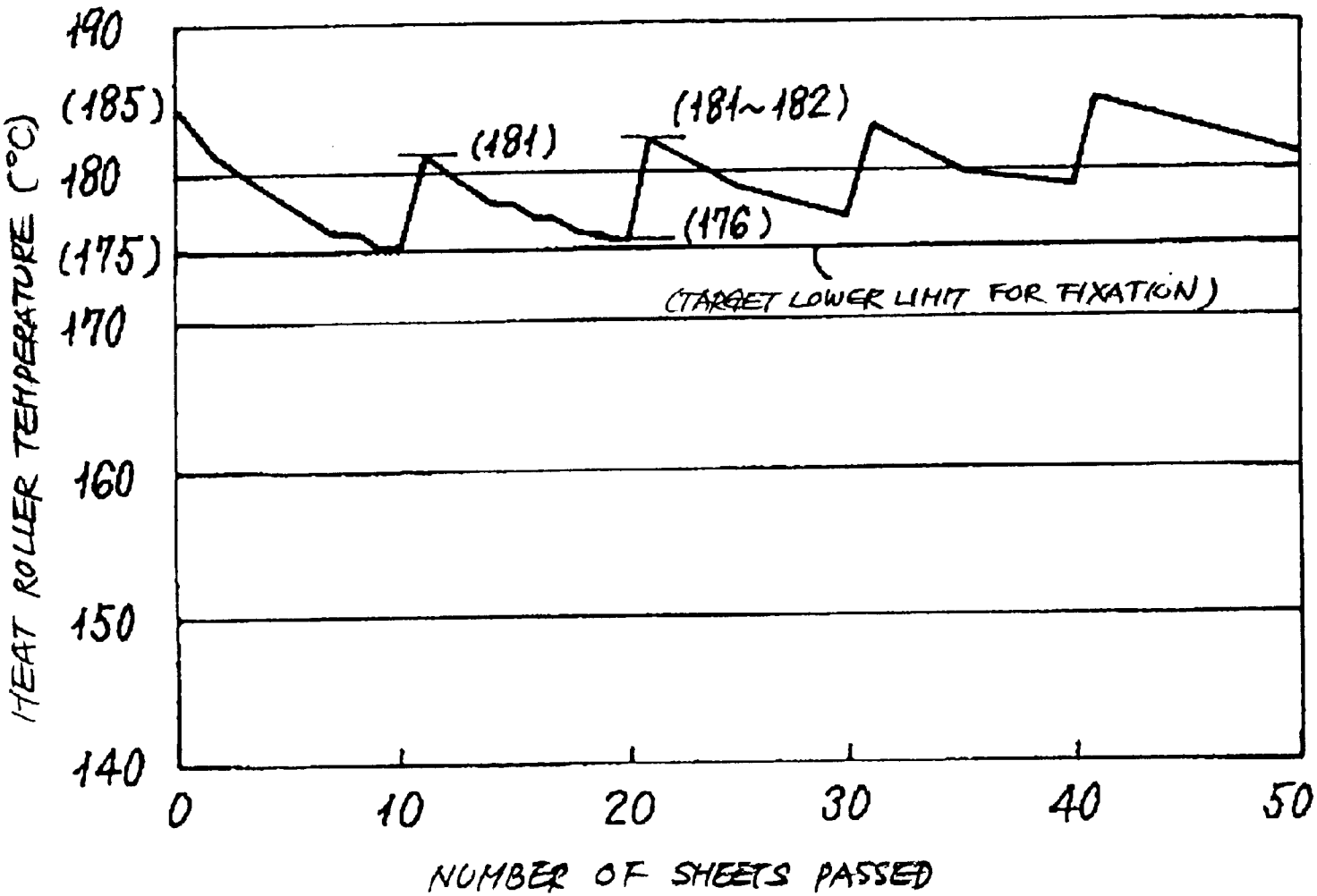
FIG. 10 is a graph demonstrating how the temperature of the heat roller varies when the rotation of the heat roller is temporarily stopped for a fixed period of time.

FIG. 10 shows the result of a first experiment conducted under the following conditions:

PPM: 70
sheet linear velocity: 360 mm/sec
duration of stop of heat roller 41: 800 ms
(including start and stop times of motor)
stop timing: every 10 sheets
sheet interval during stop: 360 mm
(corresponding to 1,000 ms)
usual sheet interval without stop: 67.6 mm
(corresponding to 188 ms)
nip width NP: 9 mm
total power for heat source (H1 and H2): 900 W
heat roller temperature (target fixing temperature):
185° C.
sheets: NBS 90K/A4 landscape
conveyance: 100 consecutive sheets just after warm-up to fixing temperature
image ratio: about 30%, evenly distributed As shown in FIG. 10, just after the start of sheet feed following warm-up to 185° C., the press roller 41, sheets and toner absorb heat of the heat roller 41, rapidly lowering the temperature of the heat roller 41. When the tenth sheet is passed, the heat roller temperature drops to the target lower limit of fixing temperature of 175° C. At this instant, however, the rotation of the heat roller 41 is interrupted for 800 ms, so that the heat roller temperature sharply rises to 181° C.

Subsequently, the eleventh sheet and successive sheets are again passed at the sheet interval time of 188 ms. At this instant, because the press roller 41 has already been warmed during the conveyance of ten sheets, the fixing temperature does not drop so much as it did when the initial ten sheets were conveyed. More specifically, the heat roller temperature is again 176° C. or so when the twentieth sheet is passed. At this time, the rotation of the heat roller 41 is again stopped for 800 ms, so that the heat roller temperature 41 is again restored to 181° C. to 182° C. Such a procedure is repeated with the twenty-first sheet and successive sheets.

The experiment showed that the temperature drop remained short of the target lower limit of 175° C. even after sheets were sequentially conveyed over 1 minute, so that power of 900 sufficed to implement 70 PPM. By interrupting the rotation of the heat roller 41 every time a preselected number of sheets are passed, as stated above, it is possible to save energy with the heat roller 41 whose wall thickness is reduced by simple control.

The rotation of the heat roller 41 is interrupted every time a preselected number of sheets are passed, as stated above, Therefore, when the fixing device 423 is driven by an exclusive driveline independent of a driveline assigned to the image forming apparatus, the control system shown in FIG. 5 is used to start and stop, in accordance with the number of sheets counted by a counter included in the control means 60, the operation of the former driveline in interlocked relation to the latter driveline. On the other hand, when the fixing device 423 shares the same driveline as the image forming apparatus, the control system shown in FIG. 6 is used to start and stop the operation of the fixing device 423 together with the image forming apparatus in accordance with the number of sheets counted by the above counter. In any case, the operation of the fixing device 423 can be easily controlled.

By adequately fixing the number of sheets to be passed and the duration of stop of rotation, it is possible to vary, based on the balance between heat generation and heat radiation, the target fixing temperature of the heat roller 41 between around 185° C. and the target lower limit of 175° C. In the illustrative embodiment, the time for stopping the rotation of the heat roller 41 precedes the time when the fixing temperature, tending to drop due to heat absorption, reaches the lower limit with or without some margin. Also, the time for ending the stop of rotation coincides with the time when the fixing temperature, dropping due to heat absorption, again starts rising.

When the heat roller temperature is subject to the control described above, the fixing temperature repeatedly rises and drops along a saw-toothed waveform in the time domain so long as sheets are sequentially conveyed via the fixing device. Consequently, the heat roller temperature can be confined in the range between the target fixing temperature of around 185° C. and the lower limit of 175° C.

Figure 11:
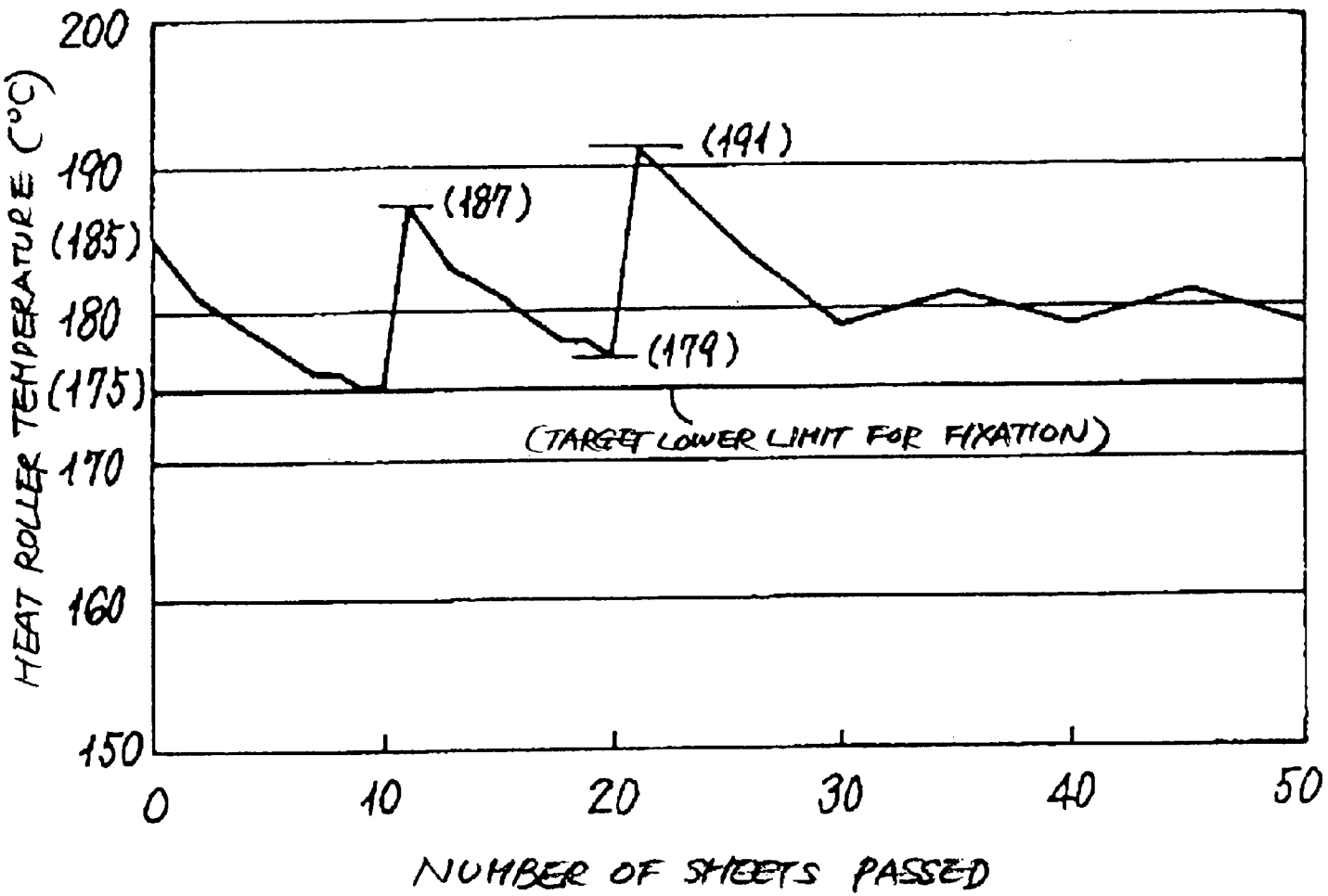
FIG. 11 is a graph demonstrating how the temperature of the heat roller varies when the rotation of the heat roller is temporarily stopped for a variable period of time.

FIG. 11 shows the result of a second experiment conducted under the following conditions:

PPM: 70 sheet linear velocity: 360 mm/sec duration of stop of rotation:

180 ms up to tenth sheet (including start and stop times of motor)

1,800 ms from eleventh to twentieth sheets zero from thirtieth sheet and successive sheets sheet interval during stop: 720 mm (corresponding to 2,000 ms)

usual sheet interval without stop: 72.12 mm (corresponding to 217 ms)

nip width NP: 9 mm total power for heat source (H1 and H2): 900 W heat roller temperature (target fixing temperature):

185° C.

sheets: NBS 90K/A4 landscape conveyance: 100 consecutive sheets just after warm-up to fixing temperature image ratio: about 30%, evenly distributed As FIG. 11 indicates, just after the start of sheet feed, the press roller 41, sheets and toner absorb heat of the heat roller 41, rapidly lowering the temperature of the heat roller 41. When the tenth sheet is passed, the heat roller temperature drops to the target lower limit of 175° C. At this instant, however, the rotation of the heat roller 41 is stopped for 1,800 ms, so that the heat roller temperature sharply rises to 187° C.

Subsequently, the eleventh sheet and successive sheets are again passed at the sheet interval time of 217 ms. At this instant, because the heat roller 41 has already been heated to 187° C., the heat roller temperature is 179° C. when the twentieth sheet is passed. At this time, the rotation of the heat roller 41 is again stopped for 1,800 ms, so that the heat roller temperature is again restored to 191° C. or so. The twenty-first sheet and successive sheets are passed at the sheet interval time of 217 ms without the rotation of the heat roller 41 being interrupted. However, the heat roller temperature remains substantially at about 180° C. because the press roller 42 has been warmed to a certain degree.

The experiment showed that power of 900 sufficed to realize the temperature drop short of 175° C. and 70 PPM.

In the second experiment, the period of time for which the rotation of the heat roller 41 is interrupted is variable. This period of time is selected such that, regarding the temperature of the heat roller 41 dropped due to the passage of sheets as a fixing temperature at the nip, the fixing temperature rises from around the lower limit of 175° C. to at least 187° C. or 191° C. higher than the target fixing temperature of 185° C. When the above period of time was 1,800 ms at both of the first and second stops and was zero thereafter, the fixing temperature was successfully held between the target fixing temperature and the target lower limit.

The duration of stop of rotation may alternatively be reduced at the second stop and successive stops, e.g., made zero in the above example. More specifically, by varying the duration of stop as the press roller 42 is heated by the heat roller 41, it is possible to confine the fixing temperature in the range of between the target fixing temperature and the target lower limit.

As stated above, by varying the duration of stop, it is possible to confine the heat roller temperature or fixing temperature in a desired range without varying PPM, which is a specification particular to an image forming apparatus used and determined in accordance with the sheet size beforehand.

3-7. Combined Control (A) The control shown in FIG. 9 (i) selects a sheet interval time shorter than usual one at the initial stage of sheet feed to thereby prevent the fixing temperature from dropping below the target lower limit, (ii) then selects a sheet interval time longer than usual one, and (iii) when the target fixing temperature is reached, selects a sheet interval time that is the mean value of the above two sheet interval times. With this procedure, it is possible to confine the fixing temperature in the range between the target fixing temperature and the target lower limit.

(B) The control shown in FIG. 10 (i') interrupts the rotation of the heat roller 41 when a sheet interval coincides with the nip at the initial stage of sheet feed and (ii') reduces the duration of interruption thereafter. This is also successful to confine the fixing temperature in the range between the target fixing temperature and the target lower limit.

The procedures (A) and (B) stated above both are capable of confining the heat roller temperature or fixing temperature in the desired range without varying the number of sheets to be output for a preselected period of time, i.e., PPM particular to an image forming apparatus used.

Combined control executes the step (i) of the control (A) at the initial stage of sheet feed and then executes the step (ii') of the control (B) or executes the step (ii) of the control (A) at the initial stage of sheet feed and then executes the step (iii) of the control (A). With this combined control, it is also possible to save energy with the heat roller 41 whose wall thickness is reduced to promote rapid warm-up.

Alternative combined control (i") selects the sheet interval time longer than usual one at the initial stage of sheet feed to thereby sufficiently warm the press roller 42 beforehand, (ii") then selects the sheet interval time shorter than usual one, and (iii") when the target fixing temperature is reached, selects the sheet interval time that is the mean value of the above two sheet interval times. Such alternative combined control also confines the fixing temperature in the range between the target fixing temperature and the target lower limit without varying PPM particular to an image forming apparatus used.

[4] Other Embodiments

While the first embodiment of the present invention includes a fixing member implemented as the heat roller 41, alternative embodiments to be described with reference to FIGS. 12 through 17 hereinafter each include a fixing member implemented as a sheet or a belt. In FIGS. 12 through 17, the press roller 42 is identical with the press roller 42 of the first embodiment in configuration and function.

Figure 12:
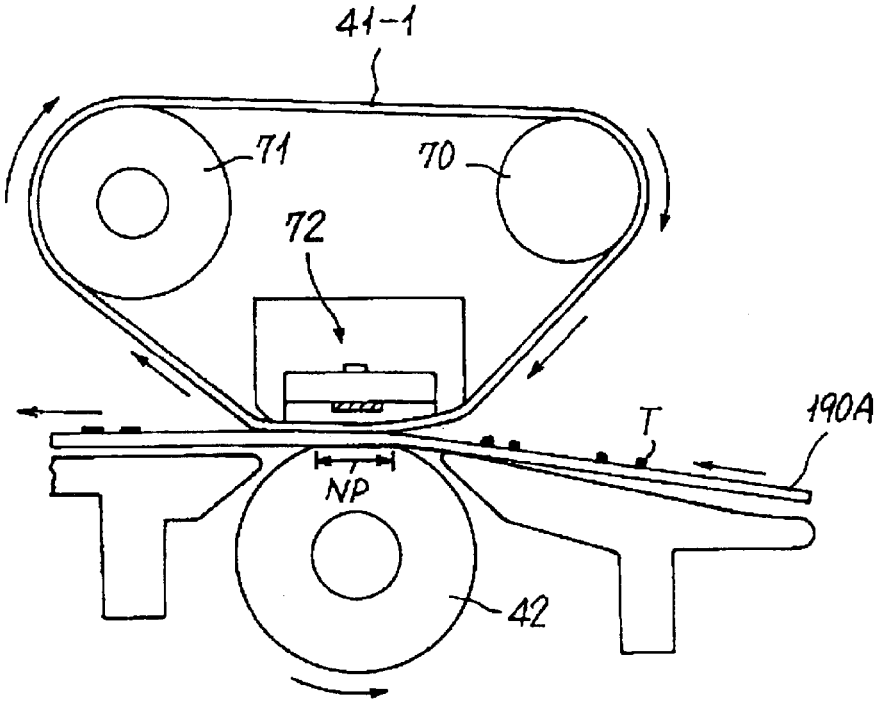
FIG. 12 shows a second embodiment of the present invention.

More specifically, in a second embodiment of the present invention shown in FIG. 12, an endless heat-resistant film 41-1 is passed over a drive roller 71 and a driven roller 70 as a fixing member. The driven roller 70, playing the role of a tension roller at the same time, applies tension to the film 41-1. The drive roller 71 causes the film 41-1 to move in a direction indicated by arrows. To reduce thermal capacity, the film 41-1 is provided with total thickness as small as 100 μm or below and implemented as a laminate made up of a polyimide or similar durable, heat-resistant film having parting ability and a PTFE coated on the film as a parting layer.

The press roller 42 faces a heater or heat source 72 with the intermediary of the film 41-1 and is rotated by the film 41-1 while pressing the film 41-1 against the heater 72. The heater 72 is an electric heater similar to the heat sources H1 and H2. When the sheet 190A, carrying the toner T thereon, is conveyed via the nip NP, the toner T is pressed against the film 41-1 and fixed thereby. A thermistor, not shown, adjoins the surface of the film 41-1 or that of the press roller 42 for measuring temperature at the nip between the film 41-1 and the press roller 42.

Figure 13:
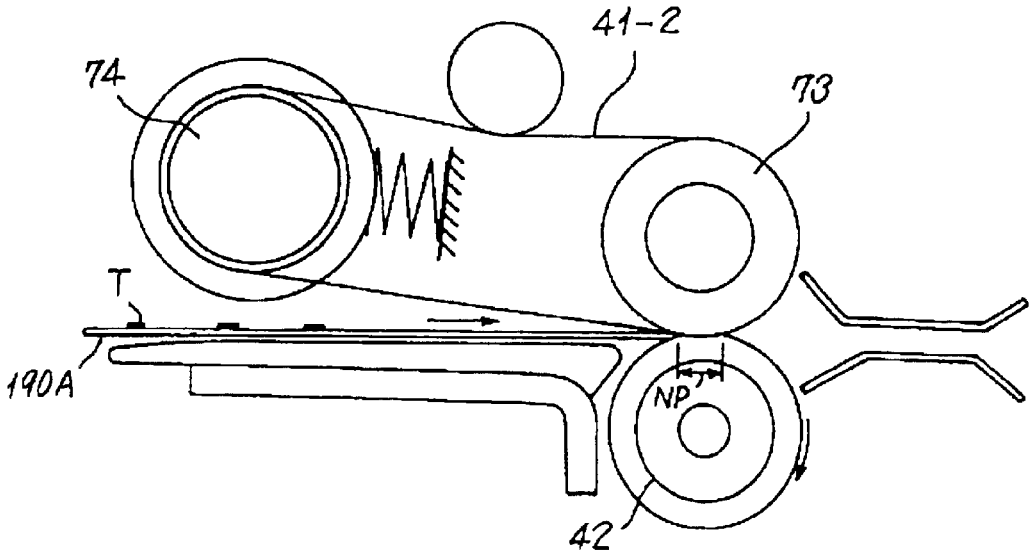
FIG. 13 shows a third embodiment of the present invention.

FIG. 13 shows a third embodiment of the present invention in which an endless belt or fixing member 41-2 is passed over a roller 73 and a heat roller 74 accommodating a heat source therein. The press roller 42 is pressed against the roller 73 via the belt 41-2. The toner T on the sheet 190A is fixed by heat when the sheet 190A is conveyed via the nip between the belt 41-2 and the press roller 42.

To reduce thermal capacity, the belt 41-2 is made up of a nickel base as thin as 100 μm and a 200 μm parting layer formed on the base by use of silicone rubber. Again, a thermistor, not shown, adjoins the surface of the belt 41-2 or that of the press roller 42 for measuring temperature at the nip between the belt 41-2 and the press roller 42.

Figure 14:
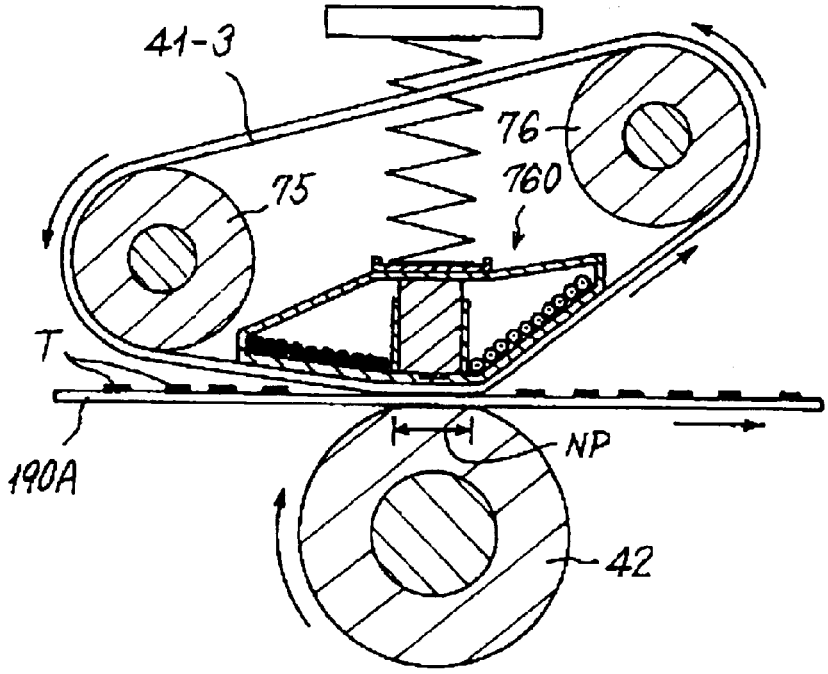
FIG. 14 shows a fourth embodiment of the present invention.

FIG. 14 shows a fourth embodiment of the present invention in which the fixing member is implemented as an endless film 41-3 that generates heat by electromagnetic induction. The film 41-3 is passed over a tension roller 75, a drive roller 76 and an electromagnetic induction coil assembly 760, which includes an induction coil. The press roller 42 is pressed against a film guide, which is formed by the underside of the coil assembly 760, via the film 41-3, forming the nip having the width NP. The drive roller 76 causes the film 41-3 to move in directions indicated by arrows in FIG. 14.

The film 41-3 is a laminate made up of a 10 μm to 100 μm thick electromagnetic induction heating layer formed of nickel or similar ferromagnetic conductive substance, a 100 μm to 1,000 μm thick elastic layer formed on the heating layer by use of, e.g., silicone, and a 1 μm to 100 μm thick parting/heat-resistant layer formed on the elastic layer by use of, e.g., fluorocarbon resin. The heating layer and parting/heat-resistant layer respectively form the innermost and outermost surfaces of the film 41-3.

The coil assembly 760 is constantly biased against the press roller 42 via the film 41-3 by a compression spring 77. High-frequency current is fed from an exciting circuit, not shown, to the exciting coil of the coil assembly 760, so that alternating magnetic fluxes are generated. As a result, eddy current is generated in the electromagnetic induction heating layer of the film 41-3 with the result that Joule heat is generated due to the resistivity of the heating layer, causing the film 41-3 to generate heat by electromagnetic induction. The coil assembly 760 is a heat source corresponding to the hat sources H1 and H2.

The toner T on the sheet 190A is fixed by heat when the sheet 190A is conveyed via the nip between the film 41-3 and the press roller 42.

Figure 15:
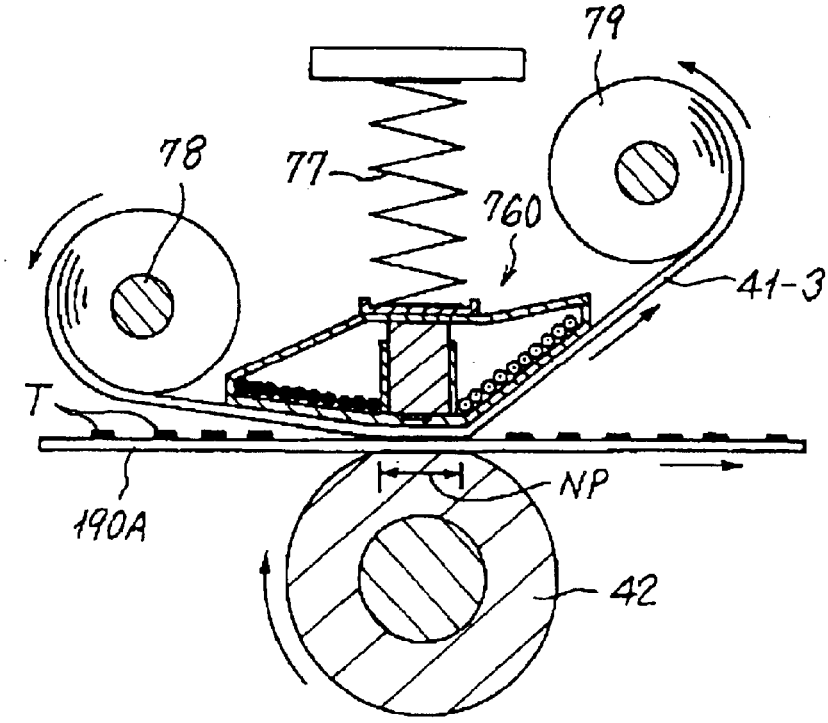
FIG. 15 shows a fifth embodiment of the present invention.

FIG. 15 shows a fifth embodiment of the present invention, which is a modified form of the fourth embodiment. As shown, the fifth embodiment differs from the fourth embodiment in that the belt 41-3 is not endless, but is wound round a feed shaft 78 and a take-up shaft 79 at opposite ends thereof. In FIG. 15, parts and elements identical with those shown in FIG. 14 are designated by identical reference numerals and will not be described specifically in order to avoid redundancy.

In the fourth and fifth embodiments, a thermistor, not shown, adjoins the surface of the belt 41-2 or that of the press roller 42 for measuring temperature at the nip having the width NP.

Figure 16:
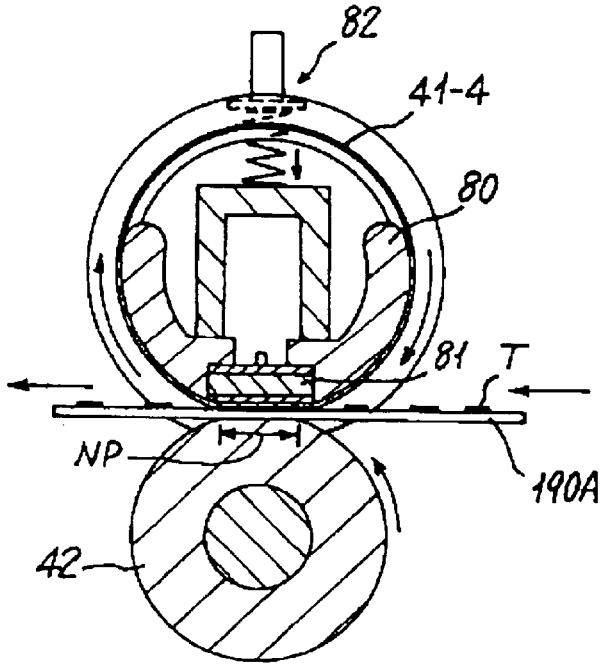
FIG. 16 shows a sixth embodiment of the present invention.

FIG. 16 shows a sixth embodiment of the present invention implemented as a film heating type of fixing device using a ceramic heater, which corresponds to the heat sources H1 and H2. As shown, a ceramic heater 81 is positioned at substantially the center of the underside of a film guide 80, which has a generally semicircular trough-like cross-section. The ceramic heater 81 is a linear heating body produced by coating an electric resistance material on a base. The fixing member is implemented as an endless, heat-resistant film 41-4 loosely coupled over the film guide 80 inclusive of the ceramic heater 81. The press roller 42 presses the film 41-4 against the underside of the ceramic heater 81, forming the nip having the width NP.

To reduce thermal capacity for thereby enhancing quick start, the film 41-4 is implemented as a polyimide film tube coated with PTFE and having a diameter of 25 mm and thickness of 100 μm or less.

A pressing mechanism 82, using a spring, constantly biases the bottom of the ceramic heater 81 against the top of the press roller 42 via the film 41-4, so that the nip having the width NP is formed.

In operation, when the press roller 42 is caused to rotate, torque acts on the film 41-4 due to friction acting between the press roller 42 and the outer surface of the film 41-4. As a result, the film 41-4 rotates around the film guide 81 at a speed substantially corresponding to the peripheral speed of the press roller 42 with the inner surface of the film 41-4 sliding on the bottom of the ceramic heater 81. The toner T on the sheet 190A is fixed by heat when the sheet 190A is conveyed via the nip between the film 41-4 and the press roller 42.

In the illustrative embodiment, a thermistor, not shown, adjoins the surface of the film 41-4 or that of the press roller 42 for measuring temperature at the nip having the width NP.

Figure 17:
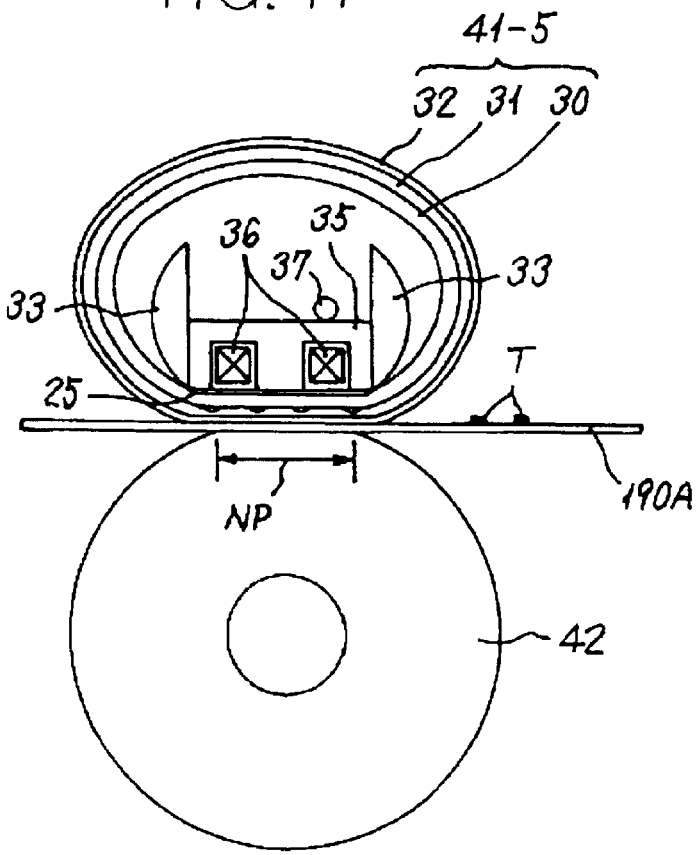
FIG. 17 shows a seventh embodiment of the present invention.

FIG. 17 shows a seventh embodiment of the present invention. As shown, a film 41-5, serving as a fixing member, is made up of a 10 μm to 100 μm thick base 30 formed of polyimide or similar resin and having low thermal conductivity, a 1 μm to 100 μm thick conductive layer 31 formed on the base 30 by use of iron or similar metal, and a parting layer 32 formed on the conductive layer 31 by using PFT or similar heat-resistant resin having high parting ability.

A stay 33 is positioned inside the film 41-5 for maintaining the running position of the film 41-5. A slide plate 34, formed of a liquid crystal polymer by way of example, is adhered to part of the stay 33 contacting the film 41-5. The stay 33 includes a core 35 formed of, e.g., iron and an exciting coil 36 wound round the core 35 for generating eddy current in the conductive layer 31. A safety device 37 is attached to the core 35 to obviate fire or smoke ascribable to overheating.

The toner T on the sheet 190A is fixed by heat when the sheet 190A is conveyed via the nip between the film 41-5 and the press roller 42.

In the illustrative embodiment, too, a thermistor, not shown, adjoins the surface of the film 41-5 or that of the press roller 42 for measuring temperature at the nip having the width NP.

In summary, it will be seen that the present invention provides a fixing device and an image forming apparatus having various unprecedented advantages, as enumerated below.

(1) It is possible to protect fixation quality from degradation ascribable to the temperature drop of a fixing member just after the start of sheet feed without increasing power to be consumed by the fixing member.

(2) Control is relatively easy to execute because the time interval between the processing of the preceding sheet and that of the following sheet is varied as the entire timer interval of an image forming process.

(3) Energy saving is achievable with a fixing roller whose wall thickness is reduced to promote warm-up without varying PPM.

(4) The chance that a pressing member absorbs the heat of the fixing member just after the start of sheet feed is reduced, so that defective fixation is obviated.

(5) By stopping the rotation of the fixing member every time a preselected number of sheets are passed, it is possible to save energy with the thin-wall fixing roller by simple control.

(6) Fixing temperature can be confined in a desired range by simple control because the duration of stop of the fixing member is fixed.

(7) The fixing temperature is variable within the desired range.

(8) The temperature of the fixing member, or fixing temperature, can be confined in the desired range without varying PPM particular to an image forming apparatus used.

(9) The width of a nip is controllable such that it lies within the interval between consecutive sheets.

(10) The fixing temperature can be raised in a short period of time.

(11) Temperature control can be executed toward the target fixing temperature.

(12) The fixing member, provided small thermal capacity, promotes rapid warm-up of the fixing roller.

(13) Heat is generated in matching relation to the sheet size, contributing a great deal to energy saving.

Various modifications will become possible for those skilled in the art after receiving the teachings of the present disclosure without departing from the scope thereof.

What is claimed is:

1. In an image forming apparatus comprising a fixing device configured to fix a toner image on a sheet with heat at a nip between a fixing member accommodating a heat source and a pressing member not accommodating a heat source, consecutive sheets are driven out of said fixing device at a variable interval without a number of sheets to be output within a preselected period of time being varied.

2. The apparatus as claimed in claim 1, wherein the interval comprises a time interval between output of a preceding sheet and output of a following sheet.

3. The apparatus as claimed in claim 2, wherein the interval comprises a distance between a trailing edge of the preceding sheet and a leading edge of the following sheet.

4. The apparatus as claimed in claim 3, wherein to vary the interval, the interval between the trailing edge of the preceding sheet and the leading edge of the following sheet is varied without a conveying speed on a sheet path being varied.

5. The apparatus as claimed in claim 4, wherein the interval is selected to be an interval α shorter than a usual interval ν for sheets conveyed to said fixing device just after a start of sheet feed, then selected to be an interval β longer than said usual interval ν for a same number of sheets as conveyed just after the start of sheet feed, and then selected to be said usual interval ν which is a mean value of the intervals α and α.

6. The apparatus as claimed in claim 5, wherein assuming that the interval is not reduced, then a period of time just after the start of sheet feed comprises a time zone in which a fixing temperature drops below a lower limit after the start of sheet feed due to absorption of heat by said pressing member.

7. The apparatus as claimed in claim 6, wherein the number of sheets to be output within the preselected period of time comprises a number of sheets to be processed for image formation for a unit period of time, which is determined in accordance with a sheet size beforehand as a specification of an image forming apparatus used, and the usual interval comprises an interval to hold when image formation is executed with the number of sheets to be output within the preselected period of time without the interval between sheets being varied.

8. The apparatus as claimed in claim 1, wherein the interval comprises a distance between a trailing edge of the preceding sheet and a leading edge of the following sheet.

9. The apparatus as claimed in claim 8, wherein to vary the interval, the interval between the trailing edge of the preceding sheet and the leading edge of the following sheet is varied without a conveying speed on a sheet path being varied.

10. The apparatus as claimed in claim 9, wherein the interval is selected to be an interval α shorter than a usual interval ν for sheets conveyed to said fixing device just after a start of sheet feed, then selected to be an interval β longer than said usual interval ν for a same number of sheets as conveyed just after the start of sheet feed, and then selected to be said usual interval ν which is a mean value of the intervals αand α.

11. The apparatus as claimed in claim 10, wherein assuming that the interval is not reduced, then a period of time just after the start of sheet feed comprises a time zone in which a fixing temperature drops below a lower limit after the start of sheet feed due to absorption of heat by said pressing member.

12. The apparatus as claimed in claim 11, wherein the number of sheets to be output within the preselected period of time comprises a number of sheets to be processed for image formation for a unit period of time, which is determined in accordance with a sheet size beforehand as a specification of an image forming apparatus used, and the usual interval comprises an interval to hold when image formation is executed with the number of sheets to be output within the preselected period of time without the interval between sheets being varied.

13. The apparatus as claimed in claim 1, wherein to vary the interval, the interval between the trailing edge of the preceding sheet and the leading edge of the following sheet is varied without a conveying speed on a sheet path being varied.

14. The apparatus as claimed in claim 13, wherein the interval is selected to be an interval $\alpha$ shorter than a usual interval $\nu$ for sheets conveyed to said fixing device just after a start of sheet feed, then selected to be an interval $\beta$ longer than said usual interval $\nu$ for a same number of sheets as conveyed just after the start of sheet feed, and then selected to be said usual interval $\nu$ which is a mean value of the intervals $\alpha$ and $\alpha$.

15. The apparatus as claimed in claim 14, wherein assuming that the interval is not reduced, then a period of time just after the start of sheet feed comprises a time zone in which a fixing temperature drops below a lower limit after the start of sheet feed due to absorption of heat by said pressing member.

16. The apparatus as claimed in claim 15, wherein the number of sheets to be output within the preselected period of time comprises a number of sheets to be processed for image formation for a unit period of time, which is determined in accordance with a sheet size beforehand as a specification of an image forming apparatus used, and the usual interval comprises an interval to hold when image formation is executed with the number of sheets to be output within the preselected period of time without the interval between sheets being varied.

17. The apparatus as claimed in claim 1, wherein the interval is selected to be an interval $\alpha$ shorter than a usual interval $\nu$ for sheets conveyed to said fixing device just after a start of sheet feed, then selected to be an interval $\beta$ longer than said usual interval $\nu$ for a same number of sheets as conveyed just after the start of sheet feed, and then selected to be said usual interval $\nu$ which is a mean value of the intervals $\alpha$ and $\alpha$.

18. The apparatus as claimed in claim 17, wherein assuming that the interval is not reduced, then a period of time just after the start of sheet feed comprises a time zone in which a fixing temperature drops below a lower limit after the start of sheet feed due to absorption of heat by said pressing member.

19. The apparatus as claimed in claim 18, wherein the number of sheets to be output within the preselected period of time comprises a number of sheets to be processed for image formation for a unit period of time, which is determined in accordance with a sheet size beforehand as a specification of an image forming apparatus used, and the usual interval comprises an interval to hold when image formation is executed with the number of sheets to be output within the preselected period of time without the interval between sheets being varied.

20. The apparatus as claimed in claim 1, wherein assuming that the interval is not reduced, then a period of time just after the start of sheet feed comprises to a time zone in which a fixing temperature drops below a lower limit after the start of sheet feed due to absorption of heat by said pressing member.

21. The apparatus as claimed in claim 20, wherein the number of sheets to be output within the preselected period of time comprises a number of sheets to be processed for image formation for a unit period of time, which is determined in accordance with a sheet size beforehand as a specification of an image forming apparatus used, and the usual interval comprises an interval to hold when image formation is executed with the number of sheets to be output within the preselected period of time without the interval between sheets being varied.

22. In an image forming apparatus comprising a fixing device configured to fix a toner image on a sheet with heat at a nip between a fixing member accommodating a heat source and a pressing member not accommodating a heat source, when said nip coincides with an interval between a trailing edge of a preceding sheet and a leading edge of a following sheet, drive of said fixing member is temporarily stopped for a variable interval without varying a number of sheets to be output within a preselected period of time.

23. The apparatus as claimed in claim 22, wherein a temporary stop of the drive occurs every time a preselected number of sheets are conveyed via said fixing device.

24. The apparatus as claimed in claim 23, wherein the temporary stop of the drive starts before a fixing temperature, tending to drop due to absorption of heat of said fixing member by the sheets, drops to a lower limit and ends when said fixing temperature, dropping toward said lower limit, again starts rising.

25. The apparatus as claimed in claim 24, wherein the fixing temperature repeatedly rises and drops, so long as the sheets are conveyed, within a range between a target fixing temperature and a target lower limit along a saw-toothed waveform in a time domain.

26. The apparatus as claimed in claim 23, wherein duration of the temporary stop of the drive is so selected as to cause the fixing temperature, dropped due to conveyance of the sheets, to again start rising to at least a level above a target fixing temperature.

27. The apparatus as claimed in claim 27, wherein the duration of the temporary stop of the drive is made shorter at a second stop and successive stops than at a first stop, which occurs just after the start of sheet feed, as the pressing member is heated by said fixing member.

28. The apparatus as claimed in claim 23, wherein the nip has a variable width.

29. The apparatus as claimed in claim 23, wherein said fixing member comprises a fixing roller having small thermal capacity and accommodating the heat source, and said pressing member comprises a pressing roller formed of an elastic material.

30. The apparatus as claimed in claim 29, wherein said fixing device comprises temperature sensing means, and the heat source is selectively turned on or turned off in accordance with an output of said temperature sensing means such that a temperature at the nip coincides with a target fixing temperature.

31. The apparatus as claimed in claim 29, wherein said fixing member comprises either one of a sheet and a belt.

32. The apparatus as claimed in claim 22, wherein the nip has a variable width.

33. The apparatus as claimed in claim 32, wherein said fixing member comprises a fixing roller having small thermal capacity and accommodating the heat source, and said pressing member comprises a pressing roller formed of an elastic material.

34. The apparatus as claimed in claim 33, wherein said fixing device comprises temperature sensing means, and the heat source is selectively turned on or turned off in accordance with an output of said temperature sensing means such that a temperature at the nip coincides with a target fixing temperature.

35. The apparatus as claimed in claim 33, wherein said fixing member comprises either one of a sheet and a belt.

36. The apparatus as claimed in claim 22, wherein said fixing member comprises a fixing roller having small thermal capacity and accommodating the heat source, and said pressing member comprises a pressing roller formed of an elastic material.

37. The apparatus as claimed in claim 36, wherein said fixing device comprises temperature sensing means, and the heat source is selectively turned on or turned off in accordance with an output of said temperature sensing means such that a temperature at the nip coincides with a target fixing temperature.

38. The apparatus as claimed in claim 36, wherein said fixing member comprises either one of a sheet and a belt.

39. In a fixing device for fixing a toner image on a sheet with heat at a nip between a fixing member being heated and a pressing member not being heated, said fixing member comprises a heat roller accommodating a heat source and a tube and an insulating layer covering an outer periphery of said tube, and said pressing member comprises a press roller, wherein the heat source comprises a heater configured to selectively generate heat at a center portion and end portions.

40. The device as claimed in claim 39, wherein said heat source comprises an electric heater configured to selectively generate heat in accordance with a size of the sheet.

41. The device as claimed in claim 39, wherein a material of the tube comprises aluminum.

42. The device as claimed in claim 39, wherein a material of the insulating layer comprises silicone.

43. The device as claimed in claim 39, wherein the press roller comprises a solid roller, and a material of the solid roller comprises silicone.

44. The apparatus according to claim 1, wherein the variable interval corresponds to a number of sheets output from the fixing device within a preceding time period.

45. The apparatus according to claim 44, wherein the variable interval comprises at least two different time intervals.

46. The apparatus according to claim 1, wherein the heat source comprises a heater having independently operable first and second heating zones.

47. The apparatus according to claim 22, wherein the variable interval corresponds to a number of sheets output from the fixing device within a preceding time period.

48. The apparatus according to claim 47, wherein the variable interval comprises at least two different time intervals.

49. The apparatus according to claim 22, wherein the heat source comprises a heater having independently operable first and second heating zones.

* * * * *